US007530654B2

(12) United States Patent
Tamura

(10) Patent No.: US 7,530,654 B2
(45) Date of Patent: May 12, 2009

(54) LIQUID EJECTION APPARATUS, LIQUID EJECTION METHOD, AND PRINTING SYSTEM

(75) Inventor: Noboru Tamura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 215 days.

(21) Appl. No.: 11/259,066

(22) Filed: Oct. 27, 2005

(65) Prior Publication Data

US 2006/0092202 A1 May 4, 2006

(30) Foreign Application Priority Data

Oct. 28, 2004 (JP) ..... 2004-314245

(51) Int. Cl.
*B41J 29/38* (2006.01)

(52) U.S. Cl. ..... 347/9; 347/5; 347/10; 347/11; 347/12

(58) Field of Classification Search ..... 347/5, 347/9–12

See application file for complete search history.

(56) References Cited

U.S. PATENT DOCUMENTS

| | | | | |
|---|---|---|---|---|
| 6,270,179 | B1 * | 8/2001 | Nou | 347/10 |
| 6,517,176 | B1 * | 2/2003 | Chaug | 347/11 |
| 6,517,267 | B1 | 2/2003 | Otsuki | |
| 6,698,954 | B2 | 3/2004 | Otsuki | |
| 6,779,866 | B2 | 8/2004 | Junhua et al. | |
| 6,811,238 | B2 | 11/2004 | Shingyohuchi | |
| 6,932,452 | B2 | 8/2005 | Nou | |
| 2005/0083359 | A1 * | 4/2005 | Tamura | 347/10 |

FOREIGN PATENT DOCUMENTS

| | | | |
|---|---|---|---|
| JP | 9-11457 | A | 1/1997 |
| JP | 2001-058434 | A | 3/2001 |
| JP | 2002-096466 | A | 4/2002 |
| JP | 2003-182075 | A | 7/2003 |
| WO | WO 01-74596 | A1 | 10/2001 |

* cited by examiner

*Primary Examiner*—Julian D Huffman
(74) *Attorney, Agent, or Firm*—Sughrue Mion, PLLC

(57) ABSTRACT

The liquid ejection apparatus includes: a head having a plurality of nozzles each for ejecting a liquid droplet, and a plurality of elements each provided in correspondence with a respective one of the nozzles; a drive signal generation section that generates a first drive signal including a plurality of waveform sections, and a second drive signal that is different from the first drive signal and that includes a plurality of waveform sections; and a controlling section that drives the element to cause the liquid droplet to be ejected from the nozzle, by selecting one of the first drive signal and the second drive signal, further selecting a predetermined waveform section from among the plurality of waveform sections included in the drive signal that has been selected, and applying, to the element, the predetermined waveform section that has been selected.

8 Claims, 15 Drawing Sheets

| pixel data SI | first switch control signal SW_A | second switch control signal SW_B |
|---|---|---|
| 00 | q0 | q4 |
| 01 | q1 | q5 |
| 10 | q2 | q6 |
| 11 | q3 | q7 |

Fig.12

LIQUID EJECTION APPARATUS, LIQUID EJECTION METHOD, AND PRINTING SYSTEM

CROSS-REFERENCE TO RELATED APPLICATIONS

The present application claims priority upon Japanese Patent Application No. 2004-314245 filed on Oct. 28, 2004, which is herein incorporated by reference.

BACKGROUND

1. Technical Field

The present invention relates to liquid ejection apparatuses, liquid ejection methods, and printing systems.

2. Related Art

Inkjet printers are known as a liquid ejection apparatus that ejects liquid droplets. With inkjet printers, ink droplets are ejected from nozzles provided in a head, and these ink droplets land on paper to form dots on the paper. Innumerable dots are formed on the paper to print a print image on the paper.

It is conceivable to change the size of the dots that are formed on the paper in order to improve the quality of the print image. It goes without saying that forming a print image using dots of various sizes, such as large dots, medium dots, and small dots, will lead to a higher image quality than if dots of uniform size are used, for example.

Forming dots of varying sizes, however, requires the size of the ink droplets that are ejected from the nozzles to be changed. To do this, it is necessary to apply various types of signals to the elements that are driven in order to eject liquid droplets. Therefore, it has conventionally been necessary to provide a number of types of drive signals corresponding to the types of sizes of ink droplets to be ejected (see, for example, JP 9-11457A).

Increasing the types of drive signals, however, complicates the structure of the apparatus.

SUMMARY

An object of the invention is to allow numerous types of signals to be applied to an element using only a few types of drive signals.

A main aspect of the invention for achieving the above object is to include:

a head having a plurality of nozzles each for ejecting a liquid droplet, and a plurality of elements each provided in correspondence with a respective one of the nozzles;

a drive signal generation section that generates a first drive signal including a plurality of waveform sections, and a second drive signal that is different from the first drive signal and that includes a plurality of waveform sections; and a controlling section that drives the element to cause the liquid droplet to be ejected from the nozzle, by selecting one of the first drive signal and the second drive signal, further selecting a predetermined waveform section from among the plurality of waveform sections included in the drive signal that has been selected, and applying, to the element, the predetermined waveform section that has been selected.

Other features of the present invention will become clear through the following description and the appended drawings.

BRIEF DESCRIPTION OF THE DRAWINGS

FIG. 12 is an explanatory diagram of the relationship between pixel data that are input to the decoder and switch control signals that are output from the decoder.

DESCRIPTION OF EXEMPLARY EMBODIMENTS

Figure 1:
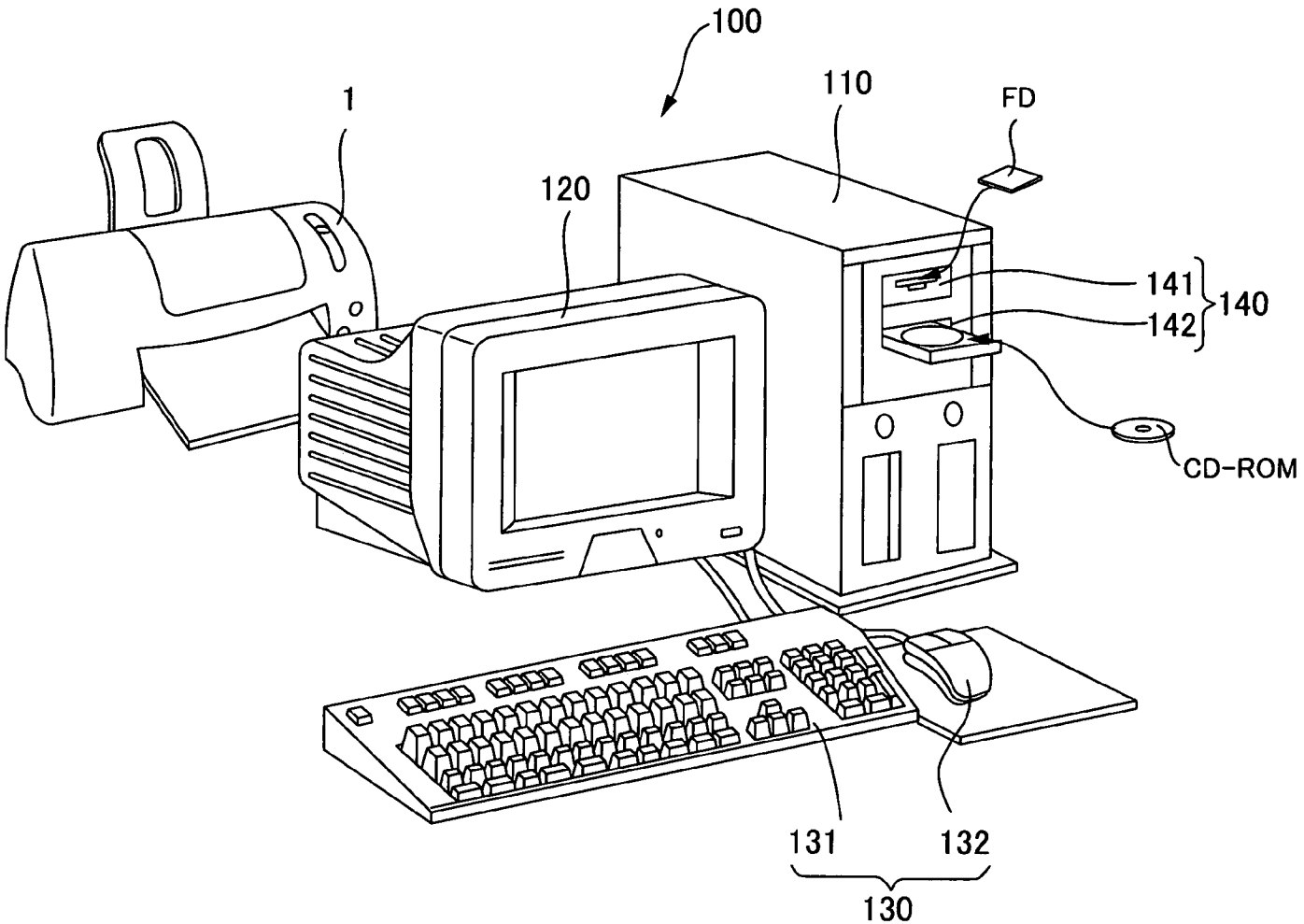
FIG. 1 is a diagram that describes a configuration of a printing system.

At least the following matters will become clear through the explanation in the present specification and the description of the accompanying drawings.

At least the following matters will become clear through the explanation in the present specification and the description of the accompanying drawings.

A liquid ejection apparatus includes:

- a head having a plurality of nozzles each for ejecting a liquid droplet, and a plurality of elements each provided in correspondence with a respective one of the nozzles;
- a drive signal generation section that generates a first drive signal including a plurality of waveform sections, and a second drive signal that is different from the first drive signal and that includes a plurality of waveform sections; and
- a controlling section that drives the element to cause the liquid droplet to be ejected from the nozzle, by
  - selecting one of the first drive signal and the second drive signal,
  - further selecting a predetermined waveform section from among the plurality of waveform sections included in the drive signal that has been selected, and
  - applying, to the element, the predetermined waveform section that has been selected.

With this liquid ejection apparatus, it is possible to apply, to an element, more types of signals than the types of drive signals.

In this liquid ejection apparatus, it is preferable that the drive signal generation section generates the first drive signal and the second drive signal by repetitively generating the plurality of waveform sections with a predetermined period; and the controlling section selects one of the first drive signal and the second drive signal in the predetermined period. In this way, it is possible to prevent both drive signals from being applied to the element.

In this liquid ejection apparatus, it is preferable that the controlling section causes liquid droplets of different sizes to be ejected from the nozzle. In this way, it is possible to form landing marks (such as dots) of different sizes on a medium.

In this liquid ejection apparatus, it is preferable that the controlling section includes a first switch for controlling application of the waveform section included in the first drive signal to the element, and a second switch for controlling application of the waveform section included in the second drive signal to the element; and when one of the first switch and the second switch is in an ON state, the controlling section puts the other switch in an OFF state. In this way, it is possible to prevent both switches from entering the ON state.

In this liquid ejection apparatus, it is preferable that the controlling section has a memory that stores drive signal selection data for selecting one of the first drive signal and the second drive signal, and waveform section selection data for selecting the waveform section from the drive signal that has been selected. In this way, it is possible to reduce the capacity of the memory for storing the drive signal selection data.

In this liquid ejection apparatus, it is preferable that the controlling section puts the other switch in the OFF state based on the drive signal selection data. In this way, both switches are prevented from entering the ON state even when there is an error in the drive signal selection data.

In this liquid ejection apparatus, it is preferable that the liquid ejection apparatus further comprises a carriage that can be moved with respect to a body of the apparatus, and a cable for transmitting signals from the body of the apparatus to the drive signal generation section and the controlling section that is provided to the carriage; and the cable transmits the first drive signal, the second drive signal, and a setting signal for setting the waveform section selection data to the memory. Such a configuration brings about an environment in which the setting signal is prone to being affected by noise and error tends to occur in the settings of the waveform section selection data, but if both switches are prevented from entering the ON state, these do not become a problem.

In this liquid ejection apparatus, it is preferable that the liquid ejection apparatus further comprises a carriage that can be moved with respect to a body of the apparatus, and a cable for transmitting signals from the body of the apparatus to the drive signal generation section and the controlling section that is provided to the carriage; and the cable transmits the first drive signal, the second drive signal, and a clock signal for causing the memory to operate. Such a configuration brings about an environment in which the clock signal is prone to being affected by noise and error tends to occur in the data that is set to the memory, but if both switches are prevented from entering the ON state, these do not become a problem.

In this liquid ejection apparatus, it is preferable that the elements are piezoelectric elements. In such a case, noise tends to occur in the periphery of the signal line of the drive signal, but if both switches are prevented from entering the ON state, this does not become a problem.

A liquid ejection method includes the steps of:

generating a first drive signal including a plurality of waveform sections, and a second drive signal that is different from the first drive signal and that includes a plurality of waveform sections;

selecting one of the first drive signal and the second drive signal, and further selecting a predetermined waveform section from among the plurality of waveform sections included in the drive signal that has been selected;

applying, to an element, the predetermined waveform section that has been selected; and driving the element to eject a liquid droplet from a nozzle.

With this liquid ejection method, it is possible to apply, to an element, more types of signals than the types of drive signals.

A printing system includes:

a computer unit; and a printing apparatus, the printing apparatus including

- a head having a plurality of nozzles each for ejecting an ink droplet, and a plurality of elements each provided in correspondence with a respective one of the nozzles,
- a drive signal generation section that generates a first drive signal including a plurality of waveform sections, and a second drive signal that is different from the first drive signal and that includes a plurality of waveform sections, and
- a controlling section that drives the element to cause the ink droplet to be ejected from the nozzle, by
  - selecting one of the first drive signal and the second drive signal,
  - further selecting a predetermined waveform section from among the plurality of waveform sections included in the drive signal that has been selected, and
  - applying, to the element, the predetermined waveform section that has been selected.

With this printing system, it is possible to apply, to an element, more types of signals than the types of drive signals.

Configuration of the Printing System

<Overall Configuration>

FIG. 1 is a diagram that illustrates a configuration of a printing system 100. This illustrative printing system 100 shown here includes a printer 1 as a printing apparatus and a computer 110 as a print control apparatus. Specifically, the printing system 100 includes the printer 1, the computer 110, a display device 120, an input device 130, and a record/play device 140.

The printer 1 prints images on media such as paper, cloth, and film. The computer 110 is communicably connected to the printer 1. In order to make the printer 1 print an image, the computer 110 outputs print data corresponding to that image to the printer 1. Computer programs such as an application program and a printer driver are installed on the computer 110. The display device 120 has a display. The display device 120 is, for example, a device for displaying a user interface of the computer programs. The input device 130 is for example a keyboard 131 and a mouse 132. The record/play device 140 is for example a flexible disk drive device 141 and a CD-ROM drive device 142.

Computer

<Regarding the Configuration of the Computer 110>

Figure 2:
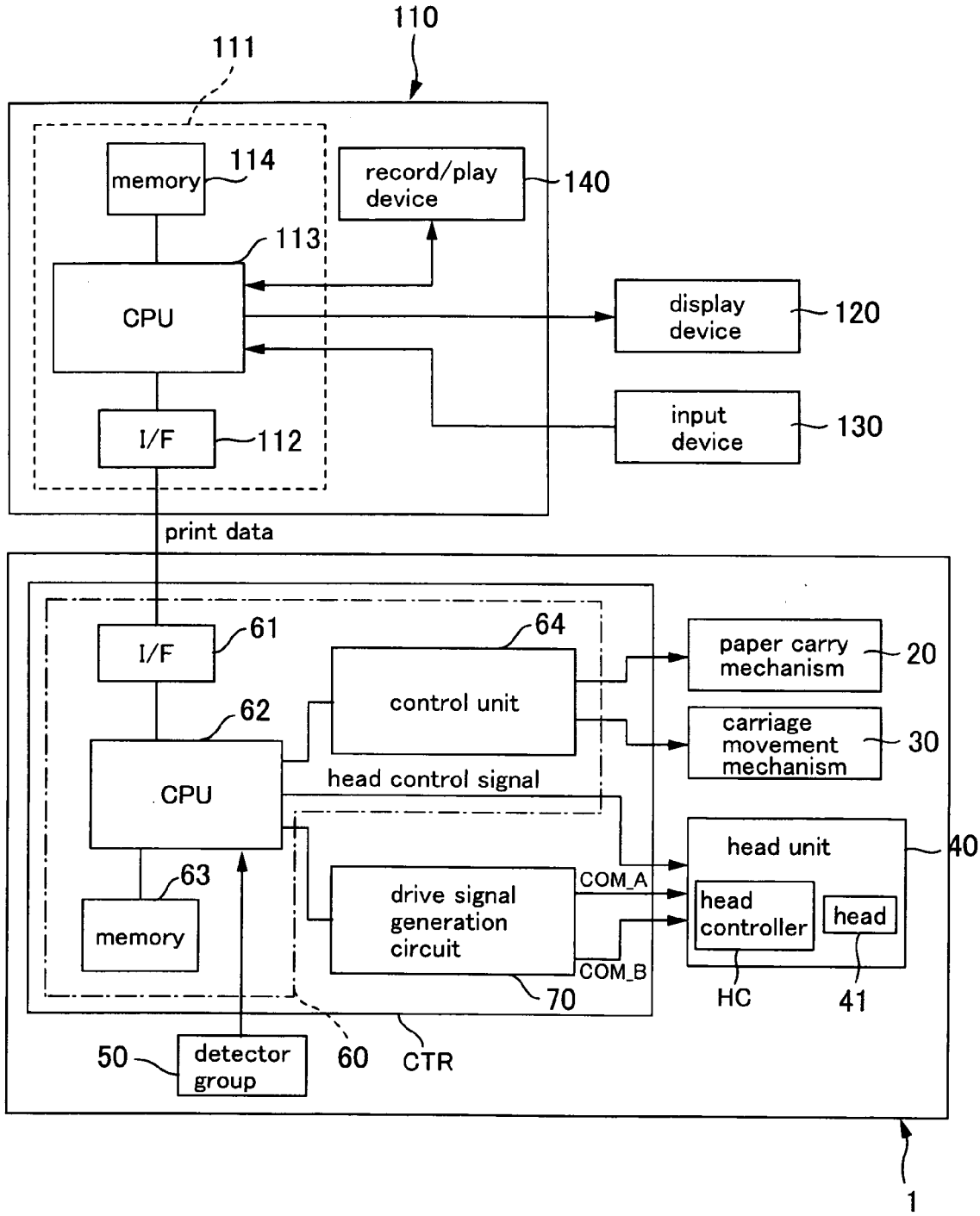
FIG. 2 is a block diagram for describing a configuration of a computer and a printer.

FIG. 2 is a block diagram that describes the configuration of the computer 110 and the printer 1. A brief description of the configuration of the computer 110 will be made first. The computer 110 has the record/play device 140 described above, and a host-side controller 111. The record/play device 140 is communicably connected to the host-side controller 111, and for example is attached to the housing of the computer 110. The host-side controller 111 performs various controls in the computer 110, and is also communicably connected to the display device 120 and the input device 130 described above. The host-side controller 111 has an interface section 112, a CPU 113, and a memory 114. The interface section 112 is interposed between the computer and the printer 1, and sends and receives data between the two. The CPU 113 is a computation processing device for performing overall control of the computer 110. The memory 114 is for reserving a working area and an area for storing computer programs used by the CPU 113, and is constituted by a RAM, EEPROM, ROM, or magnetic disk device, for example. Examples of computer programs that are stored on the memory 114 include the application program and printer driver discussed above. The CPU 113 performs various controls in accordance with the computer programs stored on the memory 114.

The printer driver makes the computer 110 convert image data into print data, and sends these print data to the printer 1. The print data are data in a form that can be interpreted by the printer 1, and have various command data and pixel data SI (see FIG. 8, etc.). Command data are data for giving commands to make the printer 1 execute specific operations. The command data include command data that commands to supply paper, command data that indicates a carry amount, and command data that commands to discharge paper. The pixel data SI are data relating to the pixels of the image to be printed.

Here, a pixel refers to a unit element making up an image, and images are formed by arranging these pixels in rows in two dimensions. The pixel data of the print data are data relating to the dots that are formed on the paper S (for example, gradation values). In this embodiment, the pixel data SI of the print data are each made of two bits of data. That is, the pixel data SI are data [00] corresponding to no dot, data [01] corresponding to a small dot, data [10] corresponding to the formation of a medium dot, or data [11] corresponding to a large dot. The printer 1 can thus form dots in four gradation levels. It should be noted that the pixel data of the image data before conversion to print data are 256-gradation RGB data or CMYK data. Additionally, the pixels in the print image are matrix-like squares virtually set on the paper S, and indicate a region in which a dot is to be formed on the paper S. That is, the print image is an image that is formed by an innumerable number of dots.

Printer

<Regarding the Configuration of the Printer 1>

Figure 3A:
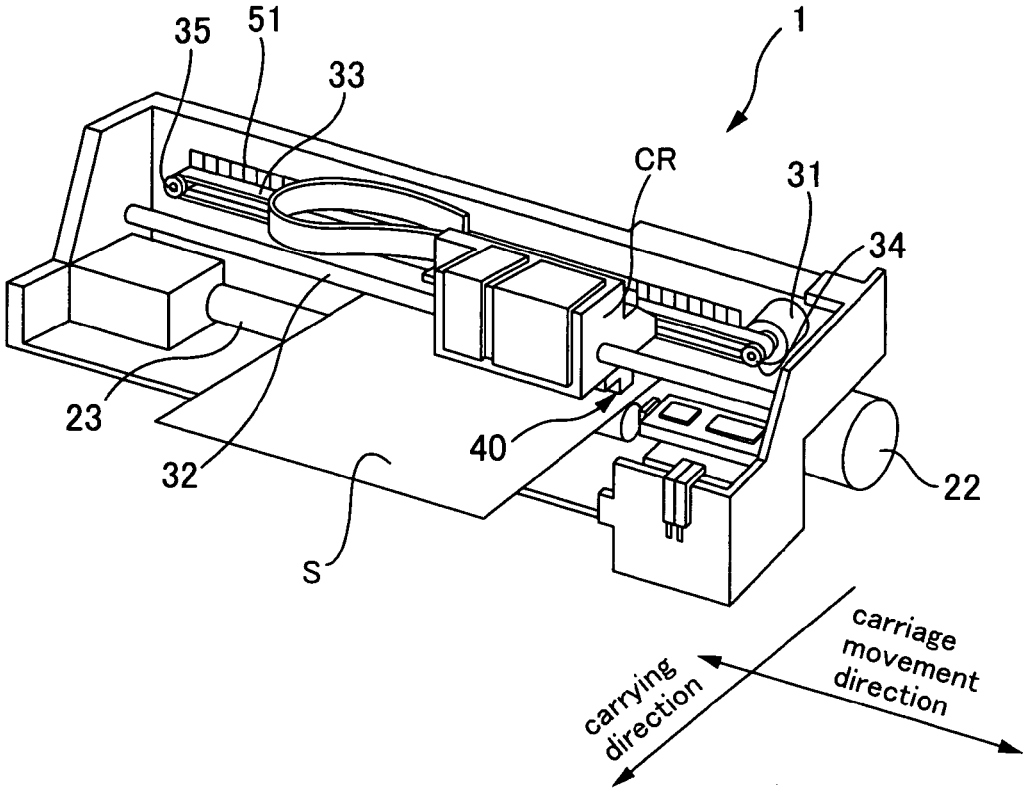
FIG. 3A shows a configuration of the printer according to an embodiment.
Figure 3B:
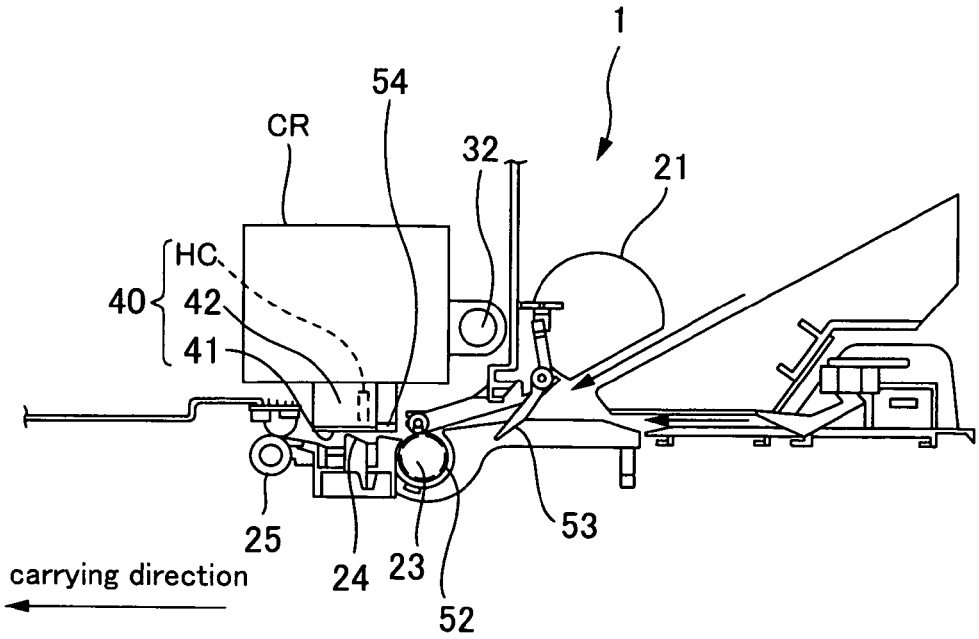
FIG. 3B is a lateral view that illustrates a configuration of the printer in that embodiment.

FIG. 3A is a diagram that shows the configuration of the printer 1 of this embodiment. FIG. 3B is a lateral view illustrating the configuration of the printer 1 of this embodiment. It should be noted that FIG. 2 also is referred to in the following description.

The printer 1 has a paper carry mechanism 20, a carriage movement mechanism 30, a head unit 40, a detector group 50, a printer-side controller 60, and a drive signal generation circuit 70. It should be noted that in the present embodiment, the printer-side controller 60 and the drive signal generation circuit 70 are provided on a common controller board CTR. Further, the head unit 40 has a head controller HC and a head 41.

In the printer 1, the printer-side controller 60 controls the control targets, that is, the paper carry mechanism 20, the carriage movement mechanism 30, the head unit 40 (the head controller HC and the head 41), and the drive signal generation circuit 70. Thus, the printer-side controller 60 causes an image to be printed on a paper S based on the print data obtained from the computer 110. The detectors of the detector group 50 monitor conditions within the printer 1. The detectors output the result of this detection to the printer-side controller 60. The printer-side controller 60 receives the detection results from the detectors and controls the control targets based on those detection results.

<Regarding the Paper Carry Mechanism 20>

The paper carry mechanism 20 corresponds to the medium carry section for carrying media. The paper carry mechanism 20 feeds the paper S to a printable position, as well as carries the paper S by a predetermined carry amount in the carrying direction. The carrying direction is a direction that intersects the carriage movement direction. The paper carry mechanism 20 has a paper feed roller 21, a carry motor 22, a carry roller 23, a platen 24, and a discharge roller 25. The paper feed roller 21 is a roller for automatically sending a paper S that has been inserted into a paper insertion opening into the printer 1, and in this example has a cross-sectional shape that resembles the letter D. The carry motor 22 is a motor for carrying the paper S in the carrying direction, and its operation is controlled by the printer-side controller 60. The carry roller 23 is a roller for carrying the paper S that has been delivered by the paper feed roller 21 up to a printable region. The operation of the carry roller 23 also is controlled by the carry motor 22. The platen 24 is a member that supports the paper S from its rear during printing. The discharge roller 25 is a roller for carrying the paper S for which printing has finished.

<Regarding the Carriage Movement Mechanism 30>

The carriage movement mechanism 30 is for moving a carriage CR, to which the head unit 40 is attached, in a carriage movement direction. The carriage movement direction includes the direction of movement from one side to the other side and the direction of movement from that other side to the one side. It should be noted that because the head unit 40 includes the head 41, the carriage movement direction corresponds to the movement direction of the head 41, and the carriage movement mechanism 30 corresponds to a head movement section that moves the head 41 in the movement direction. The carriage movement mechanism 30 has a carriage motor 31, a guide shaft 32, a timing belt 33, a drive pulley 34, and a driven pulley 35. The carriage motor 31 corresponds to the drive source for moving the carriage CR. The operation of the carriage motor 31 is controlled by the printer-side controller 60. The drive pulley 34 is attached to the rotation shaft of the carriage motor 31, and is disposed on one end side in the carriage movement direction. The driven pulley 35 is disposed on the other end side in the carriage movement direction on the side opposite from the drive pulley 34. The timing belt 33 is connected to the carriage CR and is spanned across the drive pulley 34 and the driven pulley 35. The guide shaft 32 supports the carriage CR in a manner that permits movement thereof. The guide shaft 32 is attached in the carriage movement direction. Thus, operation of the carriage motor 31 causes the carriage CR to move in the carriage movement direction along the guide shaft 32.

<Regarding the Head Unit 40>

The head unit 40 is for ejecting ink toward the paper S. The head unit 40 is attached to the carriage CR. The head 41 of the head unit 40 is provided on the lower surface of a head case 42, and the head controller HC of the head unit 40 is provided within the head case 42. It should be noted that the head controller HC is described in greater detail later.

Figure 4:
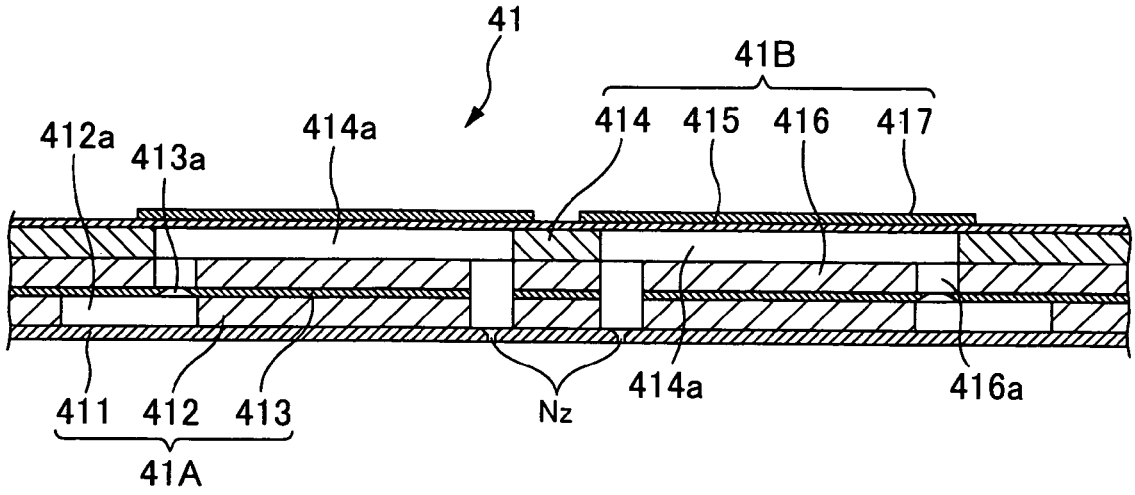
FIG. 4 is a cross-sectional view for describing a structure of a head.

FIG. 4 is a cross-sectional diagram for describing the structure of the head 41. The illustrative head 41 shown here has a channel unit 41A and an actuator unit 41B. The channel unit 41A has a nozzle plate 411 in which nozzles Nz are provided, a storage chamber formation substrate 412 in which open portions that become ink storage chambers 412a are formed, and a supply opening formation substrate 413 in which ink supply openings 413*a* are formed. The actuator unit 41B has a pressure chamber formation substrate 414 in which open portions that become pressure chambers 414*a* are formed, a vibration plate 415 that defines a portion of the pressure chambers 414*a*, a lid member 416 in which open portions that become supply-side communication openings 416*a* are formed, and piezo elements 417 formed on the surface of the vibration plate 415. A series of channels leading from the ink storage chambers 412*a* to the nozzles Nz through the pressure chambers 414*a* are formed in the head 41. At the time of use, the channels become filled with ink, and by deforming the piezo elements 417, ink can be ejected from the corresponding nozzles Nz. Thus, in the head 41, the piezo elements 417 correspond to the elements that can execute an operation for ejecting ink.

From each of the nozzles Nz, it is possible to eject a plurality of types of ink having differing quantities. For example, from each nozzle Nz it is possible to eject three different ink types, these being a large ink droplet of a quantity that allows the formation of a large dot, a medium ink droplet of a quantity that allows the formation of a medium dot, and a small ink droplet of a quantity that allows the formation of a small dot. Thus, the printer 1 can achieve four gradation levels for each pixel on the paper S, these being no dot formation, a small dot, a medium dot, and a large dot.

<Regarding the Detector Group 50>

The detector group 50 is for monitoring conditions within the printer 1. As shown in FIG. 3A and FIG. 3B, the detector group 50 includes, for example, a linear encoder 51, a rotary encoder 52, a paper detector 53, and an optical sensor 54. The linear encoder 51 is for detecting the position of the carriage CR (head 41, nozzles Nz) in the carriage movement direction. The rotary encoder 52 is for detecting the amount of rotation of the carry roller 23. The paper detector 53 is for detecting the position of the front end of the paper S being printed. The optical sensor 54 is provided on the carriage CR and is capable of detecting whether or not a paper S is present in the opposing position, and for example, can detect the width of the paper S by detecting the edge sections of the paper S while moving.

<Regarding the Printer-Side Controller 60>

The printer-side controller 60 performs control of the printer 1. The printer-side controller 60 has an interface section 61, a CPU 62, a memory 63, and a control unit 64. The interface section 61 sends and receives data to and from the computer 110, which is an external device. The CPU 62 is a computation processing device for performing the overall control of the printer 1. The memory 63 is for reserving a working area and an area for storing the programs of the CPU 62, and is constituted by a storage element such as a RAM, EEPROM, or ROM. The CPU 62 controls the sections targeted for control in accordance with the computer programs stored on the memory 63. For example, the CPU 62 controls the paper carry mechanism 20 and the carriage movement mechanism 30 via the control unit 64.

The CPU 62 outputs, to the head controller HC, head control signals for controlling the operation of the head 41 and also outputs, to the drive signal generation circuit 70, control signals for causing generation of drive signals COM. The head control signals include a transfer clock CLK, pixel data SI, a latch signal LAT, a first change signal CH_A, a second change signal CH_B, and a setting signal (described later). Further, the control signals for causing generation of drive signals COM are, for example, the DAC values. A DAC value is information for designating the voltage of the drive signal that is to be output from the first drive signal generation section 70A and/or the second drive signal generation section 70B (see FIG. 5) of the drive signal generation circuit 70, and is updated at extremely short update intervals. The DAC value is a type of generation information for causing generation of the drive signal COM.

<Regarding the Drive Signal Generation Circuit 70>

The drive signal generation circuit 70 is for generating drive signals COM used in common, and corresponds to the drive signal generation section. The drive signals COM of this embodiment are used in common for all of the piezo elements 417 corresponding to a single nozzle row.

Figure 5:
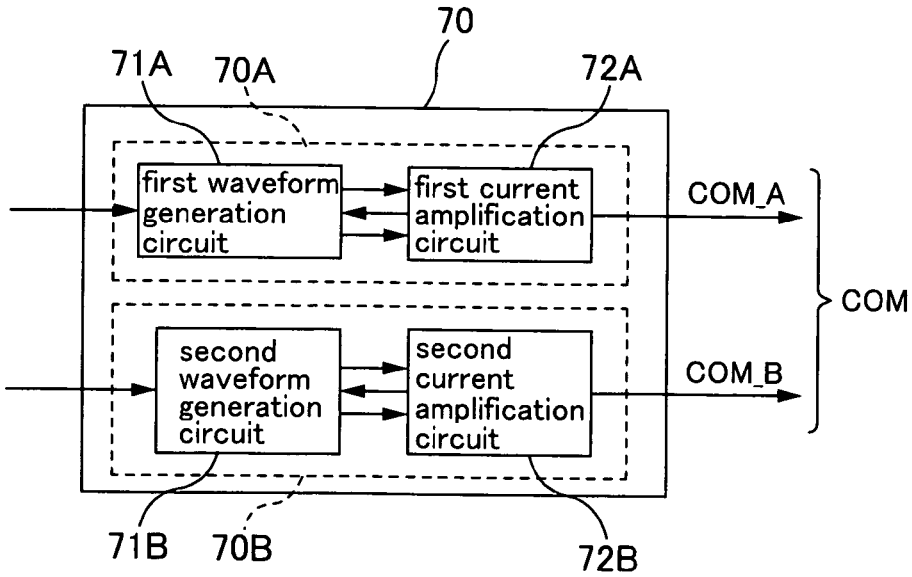
FIG. 5 is a block diagram for describing a configuration of a drive signal generation circuit.

FIG. 5 is a block diagram that describes the configuration of the drive signal generation circuit 70. The drive signal generation circuit 70 is capable of simultaneously generating a plurality of types of drive signals COM. The drive signal generation circuit 70 of this embodiment has a first drive signal generation section 70 that generates a first drive signal COM_A and a second drive signal generation section 70B that generates a second drive signal COM_B. The first drive signal generation section 70A has a first waveform generation circuit 71A which outputs a signal having a voltage corresponding to the DAC value (the generation information), and a first current amplification circuit 72A that amplifies the current of the signal that is generated by the first waveform generation circuit 71A. The second drive signal generation section 70B has a second waveform generation circuit 71B and a second current amplification circuit 72B. It should be noted that the first waveform generation circuit 71A and the second waveform generation circuit 71B have the same structure, and that the first current amplification circuit 72A and the second current amplification circuit 72B have the same structure.

The method of ejecting ink droplets using the first drive signal COM_A and the second drive signal COM_B of the present embodiment is discussed later.

<Regarding the Print Process>

Figure 6:
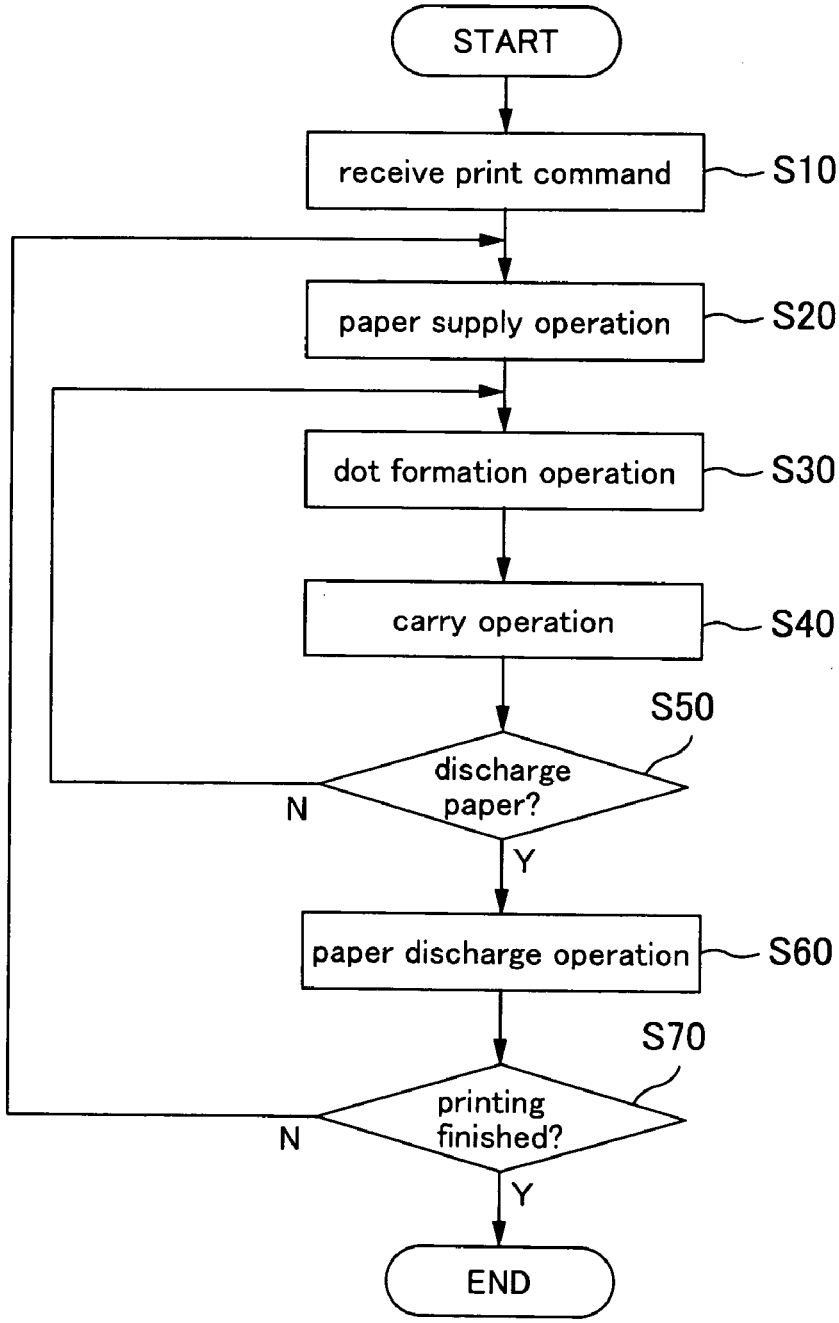
FIG. 6 is a flowchart for describing a printing process.

FIG. 6 is a flowchart describing the printing process. In the printer 1 having the above configuration, the printer-side controller 60 controls the control target sections (paper carry mechanism 20, carriage movement mechanism 30, head unit 40, drive signal generation circuit 70) in accordance with a computer program that is stored on the memory 63, thereby performing the processing of those sections. The computer program thus has codes for controlling the control target sections in order to execute the processing of those sections.

The printing process includes a print command receiving operation (S10), a paper supply operation (S20), a dot formation operation (S30), a carry operation (S40), a paper discharge determination (S50), a paper discharge process (S60), and a determination of whether or not printing has finished (S70). These operations are briefly described below.

The print command receiving operation (S10) is a process of receiving a print command from the computer 110. In this operation, the printer-side controller 60 receives a print command through the interface section 61.

The paper supply operation (S20) is an operation of moving the paper S, which is the object to be printed, to position it at a print start position (the so-called indexed position). In this operation, the printer-side controller 60 drives the carry motor 22, for example, to rotate the paper feed roller 21 and the carry roller 23.

The dot formation operation (S30) is an operation for forming dots on the paper S. In this operation, the printer-side controller 60 drives the carriage motor 31 and outputs control signals to the drive signal generation circuit 70 and the head 41. As a result, ink is ejected from the nozzles Nz during movement of the head 41, forming dots on the paper S.

The carry operation (S40) is an operation of moving the paper S in the carrying direction. In this operation, the printer-side controller 60 drives the carry motor 22 to rotate the carry roller 23. Through this carry operation, it becomes possible to form dots at positions that are different from those of the dots formed through the previous dot formation operation.

The paper discharge determination (S50) is an operation of determining whether or not it is necessary to discharge the paper S, which is the object being printed. This determination is made by the printer-side controller 60 based on whether or not there are print data, for example.

The paper discharge process (S60) is a process of discharging the paper S, and is performed if "discharge paper" is the result of the above-mentioned paper discharge determination. In this case, the printer-side controller 60 rotates the paper discharge roller 25 so as to discharge the paper S, for which printing has finished, to the outside.

The print end determination (S70) is a determination regarding whether or not to continue printing. This determination also is performed by the printer-side controller 60.

Ink Ejection Method Using Two Drive Signals According to Present Embodiment

<Regarding the Generated Drive Signals COM>

Figure 7:
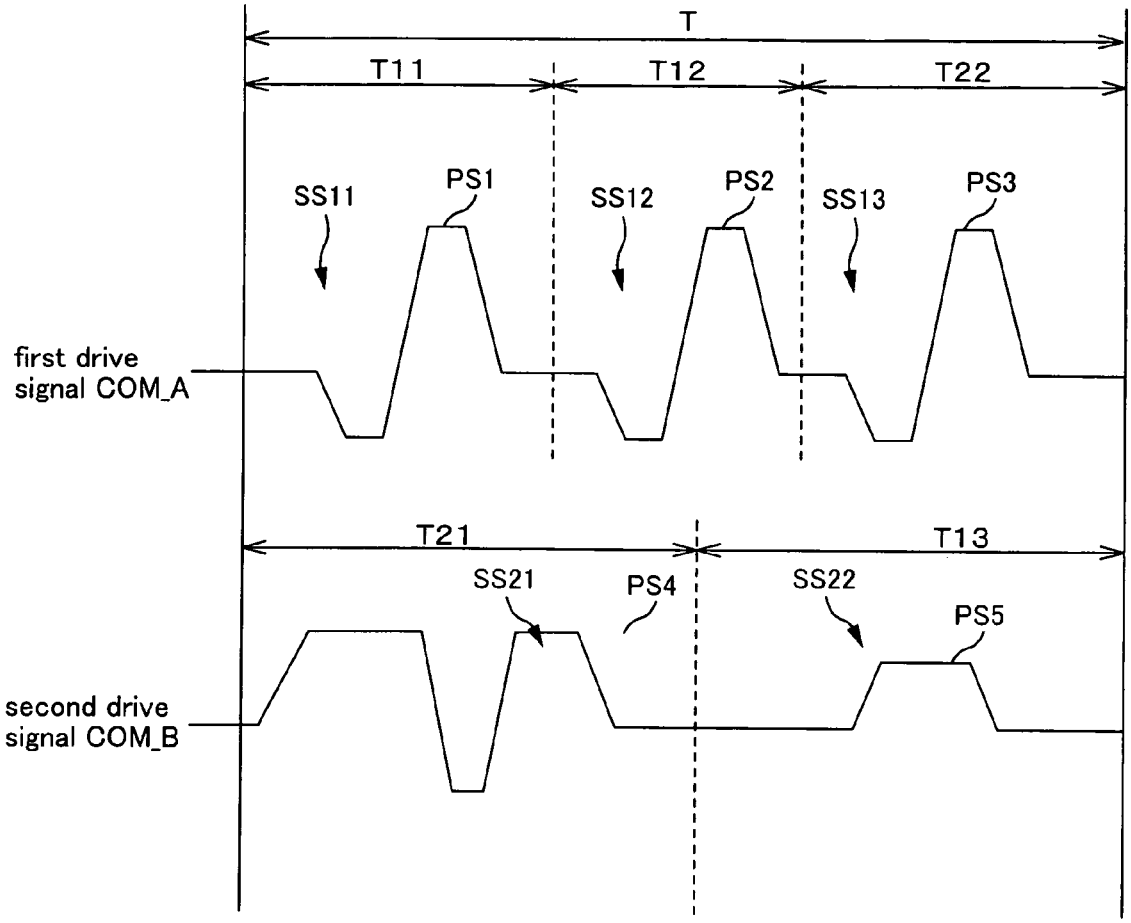
FIG. 7 is an explanatory diagram of two types of drive signals COM.

FIG. 7 is an explanatory diagram of the two types of drive signals COM that are generated by the drive signal generation circuit 70. The drive signal generation circuit 70 generates a first drive signal COM_A and a second drive signal COM_B. That is, the first drive signal generation section 70A generates the first drive signal COM_A based on the first DAC value (corresponding to the first generation information), and the second drive signal generation section 70B generates the second drive signal COM_B based on the second DAC value (corresponding to the second generation information).

The first drive signal COM_A has a first waveform section SS11 that is generated in a period T11 of a repeat period T, a second waveform section SS12 that is generated in a period T12, and a third waveform section SS13 that is generated in a period T13. Here, the first waveform section SS11 has a drive pulse PS1. Similarly, the second waveform section SS12 has a drive pulse PS2 and the third waveform section SS13 has a drive pulse PS3. The drive pulse PS1, the drive pulse PS2, and the drive pulse PS3 are applied to the piezo elements 417 when a large dot is to be formed, and have the same waveform. In other words, the drive pulse PS1, the drive pulse PS2, and the drive pulse PS3 define the start to the end of the operation for causing ink ejection when forming large dots. It should be noted that the drive pulse PS2 is applied to the piezo elements 417 also when a medium dot is to be formed. In other words, the drive pulse PS2 defines the start to the end of the operation for causing ink ejection when forming medium dots. By applying the drive pulse PS2 to a piezo element 417, a medium ink droplet is ejected from the head 41 (the corresponding nozzle Nz).

The second drive signal COM_B has a first waveform section SS21 that is generated in a period T21, and a second waveform section SS22 that is generated in a period T22. In the second drive signal COM_B, the first waveform section SS21 has a drive pulse PS4 and the second waveform section SS22 has a drive pulse PS5. Here, the drive pulse PS4 is applied to the piezo elements 417 when a small dot is to be formed. By applying the drive pulse PS4 to a piezo element 417, a small ink droplet is ejected from the head 41. Accordingly, the drive pulse PS4 defines the start to the end of the operation for causing ink ejection when forming small dots. Further, the drive pulse PS5 is applied to the piezo elements 417 when no dot is to be formed. It should be noted that when the drive signal PS5 is applied to the piezo elements 417, ink droplets are not ejected from the head 41, but the ink within the ink storage chamber 412*a* and the pressure chamber 414*a* of the head 41 is slightly vibrated, and this prevents the ink from clogging the nozzles Nz. In other words, the drive pulse PS5 defines the start to the end of the operation for causing ink to be agitated within a nozzle Nz.

As regards the first drive signal COM_A and the second drive signal COM_B, each waveform section therein can be applied individually to the piezo elements 417. That is, it is possible to selectively apply a portion of the first drive signal COM_A and/or the second drive signal COM_B to the piezo elements 417. Therefore, each waveform section is the unit (application unit) applied to the piezo element 417. It should be noted that the control for applying the waveform sections to the piezo elements 417 will be described in detail further below.

<Regarding the Head Controller HC>

Figure 8:
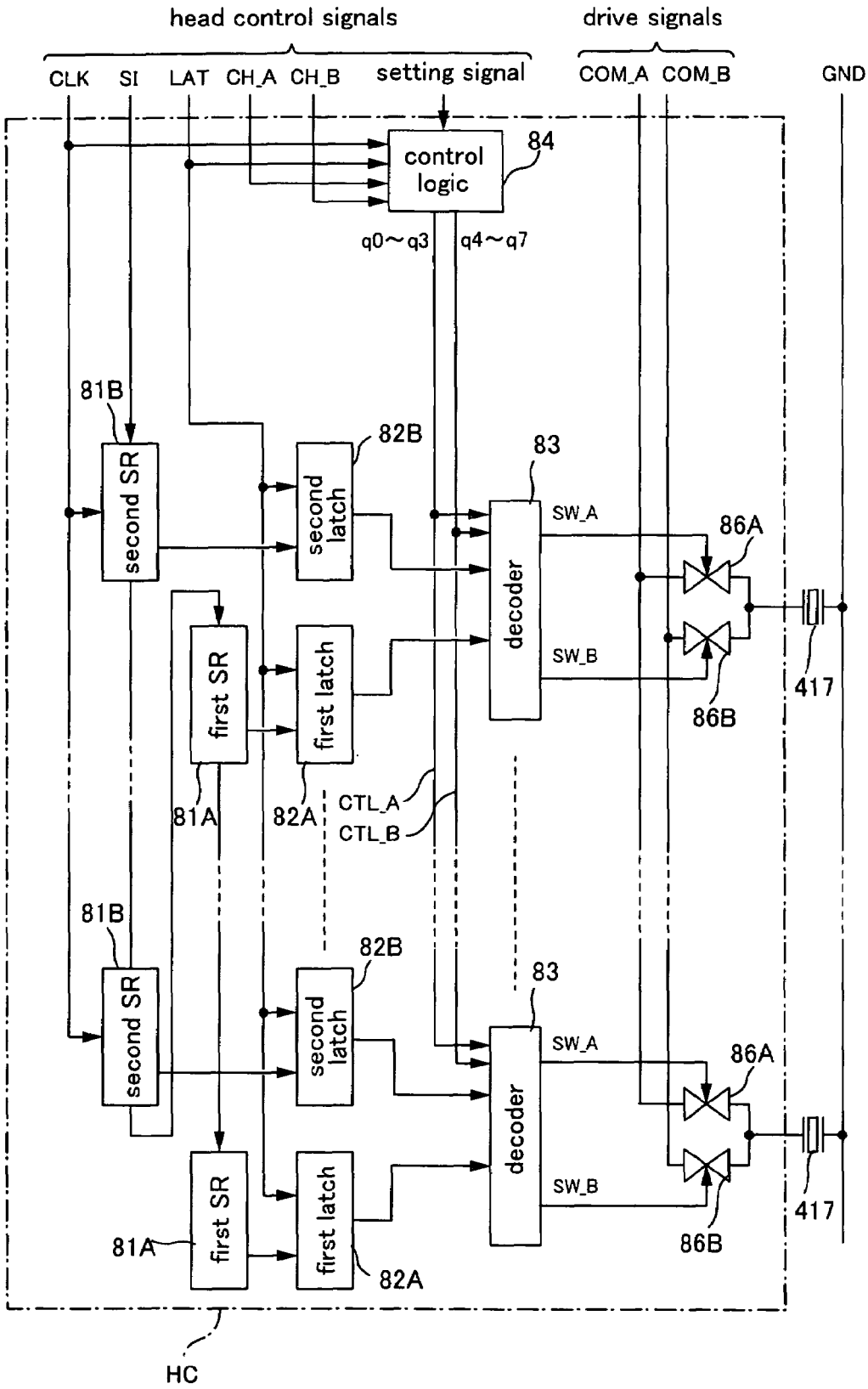
FIG. 8 is a block diagram for describing a configuration of a head controller.

FIG. 8 is a block diagram that describes the configuration of the head controller HC.

The head controller HC is provided with first shift registers 81A, second shift registers 81B, first latch circuits 82A, second latch circuits 82B, decoders 83, a control logic 84, first switches 86A, and second switches 86B. Each of the sections other than the control logic 84 (that is, the first shift register 81A, the second shift register 81B, the first latch circuit 82A, the second latch circuit 82B, the decoder 83, the first switch 86A, and the second switch 86B) is provided for each one of the piezo elements 417.

The head controller HC performs control for ejecting ink based on the pixel data SI from the printer-side controller 60. That is, the head controller HC controls the first switch 86A and the second switch 86B based on print data and causes the necessary waveform sections of the first drive signal COM_A and the second drive signal COM_B to be selectively applied to the piezo elements 417. In this embodiment, each pixel data SI is made of two bits, and is delivered to the recording head 41 in synchronization with the clock signal CLK. The high-order bit group of the pixel data SI is set in the first shift registers 81A, and the low-order bit group is set in the second shift registers 81B. The first shift registers 81A are electrically connected to the first latch circuits 82A, and the second shift registers 81B are electrically connected to the second latch circuits 82B. When the latch signal LAT from the printer-side controller 60 becomes the H level, the first latch circuits 82A latch the high-order bit of the corresponding pixel data SI and the second latch circuits 82B latch the low-order bit of that pixel data SI. Each pixel data SI that has been latched by the first latch circuit 82A and the second latch circuit 82B (the pair of the high-order bit and the low-order bit) is input to the decoder 83. The decoder 83 selects a single pair of selection signals (for example, the selection signal q0 and the selection signal q4) of the selection signals q0 to q7 that are output from the control logic 84 according to the pixel data SI that have been latched by the first latch circuit 82A and the second latch circuit 82B, and outputs that selected pair of selection signals as a first switch control signal SW_A and a second switch control signal SW_B. The first drive signal COM_A is input to the first switch 86A, and the second drive signal COM_B is input to the second switch 86B. The switches are turned on and of f in accordance with the switch control signals, and selectively apply the waveform sections included in the drive signals COM to the piezo elements 417.

<Regarding the Control Logic 84>

Figure 9:
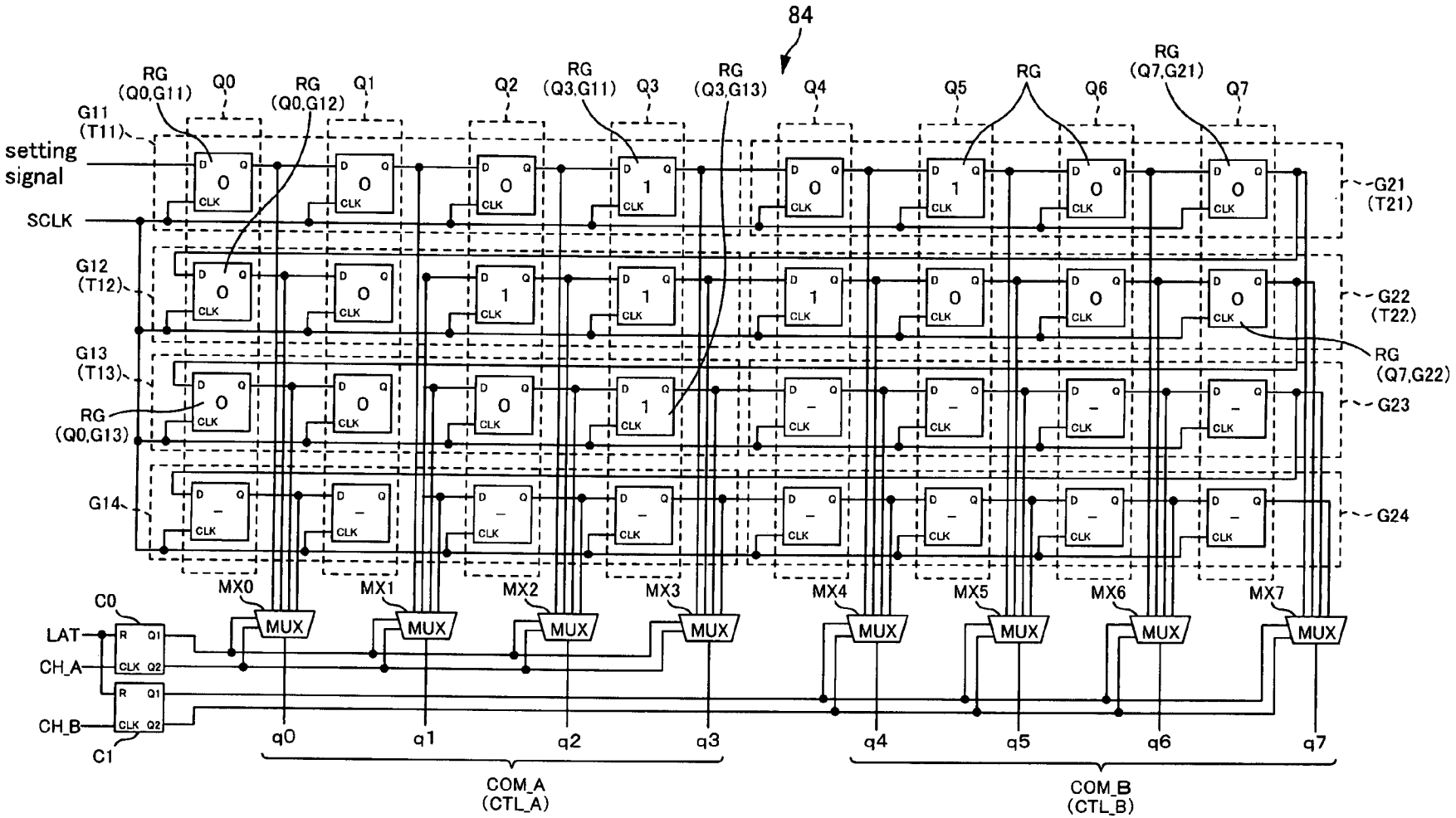
FIG. 9 is an explanatory diagram of a control logic.
Figure 10:
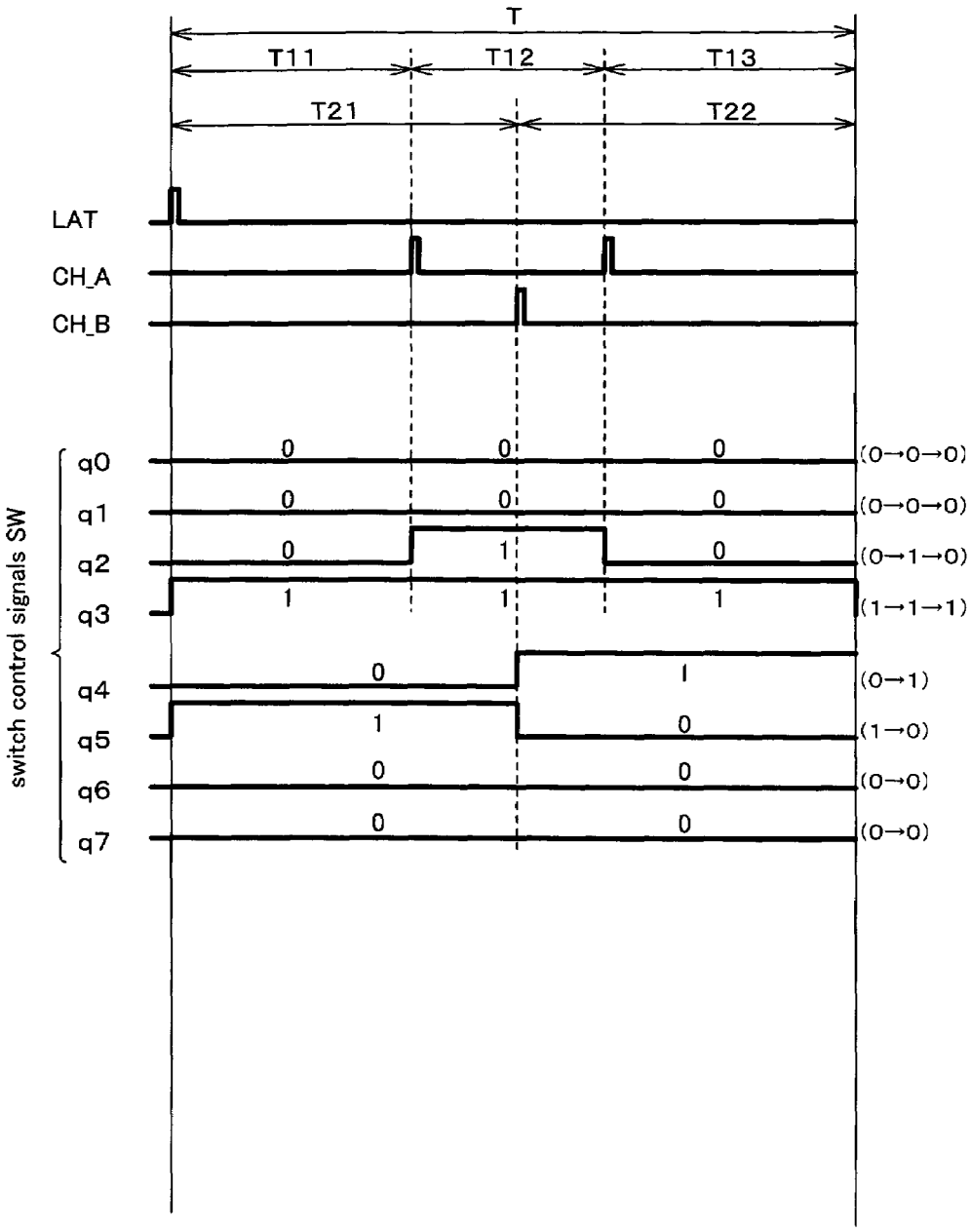
FIG. 10 is an explanatory diagram of head control signals and selection signals.

FIG. 9 is an explanatory diagram of the control logic 84. FIG. 10 is an explanatory diagram of the head control signals (latch signal LAT, first change signal CH_A, and second change signal CH_B) that are input to the control logic 84, and the selection signals q0 to q7 that are output from the control logic 84.

The control logic 84 has a plurality of registers RG each capable of storing one bit of data. Each register RG is constituted by, for example, a D-FF (delay flip flop) circuit. Each register RG stores predetermined selection data based on the setting signal from the printer-side controller 60. The selection data are consecutively updated at a predetermined timing. The content of the selection data is changed when the print mode is changed, for example.

For the sake of simplifying the description, in FIG. 9, the registers RG are disposed in a matrix of four registers in the column direction (vertical direction) and eight registers in the row direction (horizontal direction). The four registers RG belonging to the same column are grouped together, and starting from the group on the left are assigned numbers Q0 through Q7. The registers RG are divided into register groups located on the left side in the row direction (groups Q0 to Q3) and register groups located on the right side in the row direction (groups Q4 to Q7). Regarding the register groups located on the left side, the four registers RG belonging to the same row are grouped together and assigned numbers G11 to G14 in order from the group located at the top. The same applies for the register groups located on the right side, with the groups being assigned numbers G21 to G24 in order from the group located at the top.

The above groupings are made according to the role of the registers RG. First, the registers RG belonging to the groups Q0 to Q3 located on the left side in the row direction store selection data for setting the first selection signals q0 to q3 for the first drive signal COM_A. Similarly, the registers RG belonging to the four groups Q4 to Q7 located on the right side in the row direction store selection data for setting the second selection signals q4 to q7 for the second drive signal COM_B.

Furthermore, the registers RG belonging to the same row can store the selection signals of the same waveform section. To describe this more specifically, the registers RG belonging to group G11 store selection data for the first waveform section SS11, which is generated in period T11. The registers RG belonging to group G12 store selection data for the second waveform section SS12, which is generated in period T12. Similarly, the registers RG belonging to group G13 store selection data for the third waveform section SS13, which is generated in period T13. It should be noted that the registers RG belonging to group G14 are not used in this embodiment. In a case where the first drive signal COM_A is made of four waveform sections, the registers RG of this group G14 will store the selection data for a fourth waveform section. On the other hand, the registers belonging to group G21 store the selection data for the first waveform section SS21, which is generated in period T21, and the registers belonging to group G22 store the selection data for the second waveform section SS22, which is generated in period T22. In this embodiment, the registers RG belonging to group G23 and the registers RG belonging to group G23 are not used.

The registers RG of the control logic 84 can be said to store selection data determined by factors including the type of the corresponding drive signal COM (first drive signal COM_A, second drive signal COM_B), the corresponding pixel data SI (data value [00] through data value [11]), and the corresponding waveform section (for example, first waveform section SS11 or second waveform section SS22). For example, the register RG (Q0, G11) belonging to both group Q0 and group G11 stores selection data corresponding to the first waveform section SS11 of the first drive signal COM_A in pixel data SI for no-dot formation (data value [00]). The register RG (Q3, G13) belonging to both group Q3 and group G13 stores selection data corresponding to the third waveform section SS13 of the first drive signal COM_A in pixel data SI for a large dot (data value [11]). Similarly, the register RG (Q7, G22) belonging to both group Q7 and group G22 stores selection data corresponding to the second waveform section SS22 of the second drive signal COM_B in pixel data SI for a large dot.

Due to multiplexers MX0 through MX7, the selection data stored on the registers RG are sequentially updated at a timing defined by the latch pulse of the latch signal LAT, and the change pulse of the first change signal CH_A or the second change signal CH_B. Here, a two-bit control is input to the multiplexers MX0 to MX3 from the first counter C0, and this two-bit control input is switched at the timing defined by the latch pulse of the latch signal LAT and the change pulse of the first change signal CH_A. Likewise, a two-bit control is input to the multiplexers MX4 to MX7 from the second counter C1, and this two-bit control input is switched at the timing defined by the latch pulse of the latch signal LAT and the change pulse of the second change signal CH_B. Thus, the multiplexers MX0 to MX7 select selection data at the timing of the forward edge of the latch pulse and the change pulses. Then, the selection data that have been selected by the multiplexers MX0 to MX7 are output as first selection signals q0 to q3 for the first drive signal COM_A and second selection signals q4 to q7 for the second drive signal COM_B.

As shown in FIG. 9, in this embodiment, a one-bit selection data value of [0] or [1] is stored on each register RG. When the control logic 84 in which selection data have been set in this manner receives a latch signal LAT, a first change signal CH_A, and a second change signal CH_B such as those shown in FIG. 10, it outputs selection signals q0 to q7 such as those shown in FIG. 10.

For example, attention is paid to the registers of group Q2. An L-level signal is output as the selection signal q2 in correspondence with the selection data [0] stored on the register RG (Q2, G11) belonging to group G11, during the period T11 from input of the initial latch signal LAT until input of the first change signal CH_A. On the other hand, an H-level signal is output as the selection signal q2 in correspondence with the selection data [1] stored on the register RG (Q2, G12) belonging to group G12, during the period T12 from input of the initial first change signal CH_A until input of the second first change signal CH_A. Then, an L-level signal is output as the selection signal q2 in correspondence with the selection data [0] stored on the register RG (Q2, G13) belonging to group 13, during the period 13 from input of the second first change signal CH_A until input of the next latch signal LAT. As a result, the selection signal q2 becomes a signal that changes from 0 (L level) to 1 (H level) and then back to 0 (L level)

during the period T. That is, the selection data stored on the registers RG of the group 2 become data for setting the selection signal q2.

<Regarding the Decoder 83>

Figure 11:
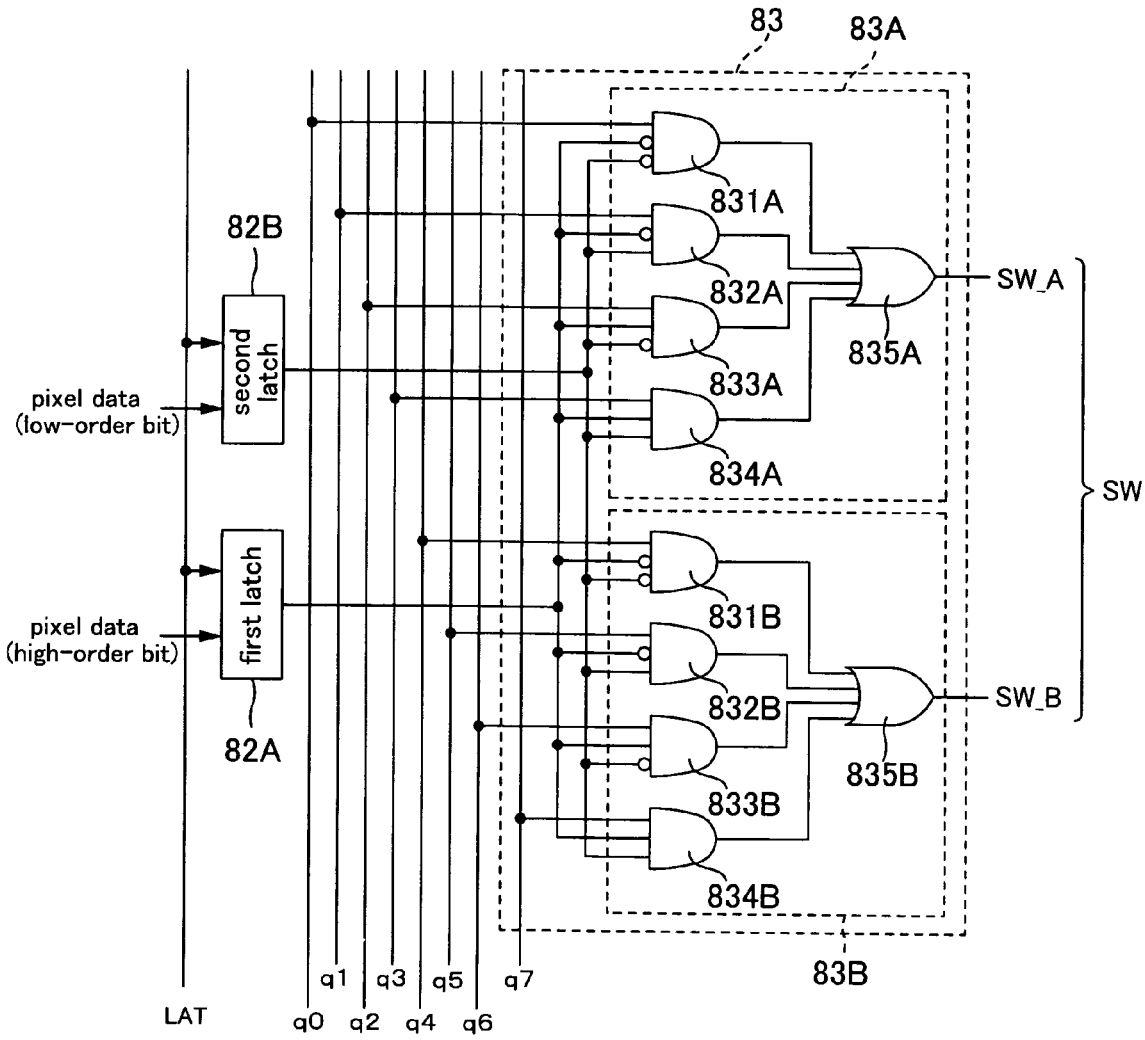
FIG. 11 is an explanatory diagram of a decoder.

FIG. 11 is an explanatory diagram of the decoder 83. FIG. 12 is an explanatory diagram of the relationship between the two-bit pixel data input to the decoder 83 and the first switch control signal SW_A and the second switch control signal SW_B that are output from the decoder 83.

The decoder 83 is described next. The decoder 83 selects the selection signals, from among the first selection signals q0 to q3 and from the second selection signals q4 to q7, that correspond to the latched pixel data SI, and outputs these as the switch control signal SW. The decoder 83 has a first decoding section 83A that outputs the first switch control signal SW_A and a second decoding section 83B that outputs the second switch control signal SW_B.

The first decoding section 83A has four AND gates 831A to 834A and a single OR gate 835A. Each AND gate 831A to 834A has three input terminals and one output terminal, and receives one of the first selection signals q0 to q3, the data of the high-order bit of the pixel data SI, and the data of the low-order bit of the pixel data SI. The AND gates 831A to 834A each receives the data of the high-order bit of the pixel data SI and the data of the low-order bit of the pixel data SI differently. That is, the AND gate 831A receives the first selection signal q0 for no dot formation, the inverted data of the high-order bit of the pixel data SI, and the inverted data of the low-order bit of the pixel data SI. Thus, if the pixel data SI are the data [00], then the output from the AND gate 831A is in accordance with the first selection signal q0 for no dot formation. Likewise, the AND gate 832A receives the first selection signal q1 for a small dot, the inverted data of the high-order bit of the pixel data SI, and the data of the low-order bit of the pixel data SI. Thus, if the pixel data SI are the data [01], then the output from the AND gate 832A is in accordance with the first selection signal q1 for a small dot. The AND gate 833A receives the first selection signal q2 for a medium dot, the data of the high-order bit of the pixel data SI, and the inverted data of the low-order bit of the pixel data SI. Thus, if the pixel data SI are the data [10], then the output from the AND gate 832A is in accordance with the first selection signal q2 for a medium dot. Further, the AND gate 834A receives the first selection signal q3 for a large dot, the data of the high-order bit of the pixel data SI, and the data of the low-order bit of the pixel data SI. Thus, if the pixel data SI are the data [11], then the output from the AND gate 832A is in accordance with the first selection signal q3 for a large dot.

The OR gate 835A has four input terminals and one output terminal. At its four input terminals it receives the output from the AND gates 831A to 834A. The first switch control signal SW_A is output from the OR gate 835A. That is, a first selection signal q0 to q3 that corresponds to the pixel data SI that have been latched is selected and output as the first switch control signal SW_A.

The second decoding section 83B has the substantially the same structure as the first decoding section. A second selection signal q4 to q7 that corresponds to the pixel data SI that have been latched is selected and output from the OR gate 835B of the second decoding section 83B as the second switch control signal SW_B.

<Regarding the Gradation Control>

Figure 13:
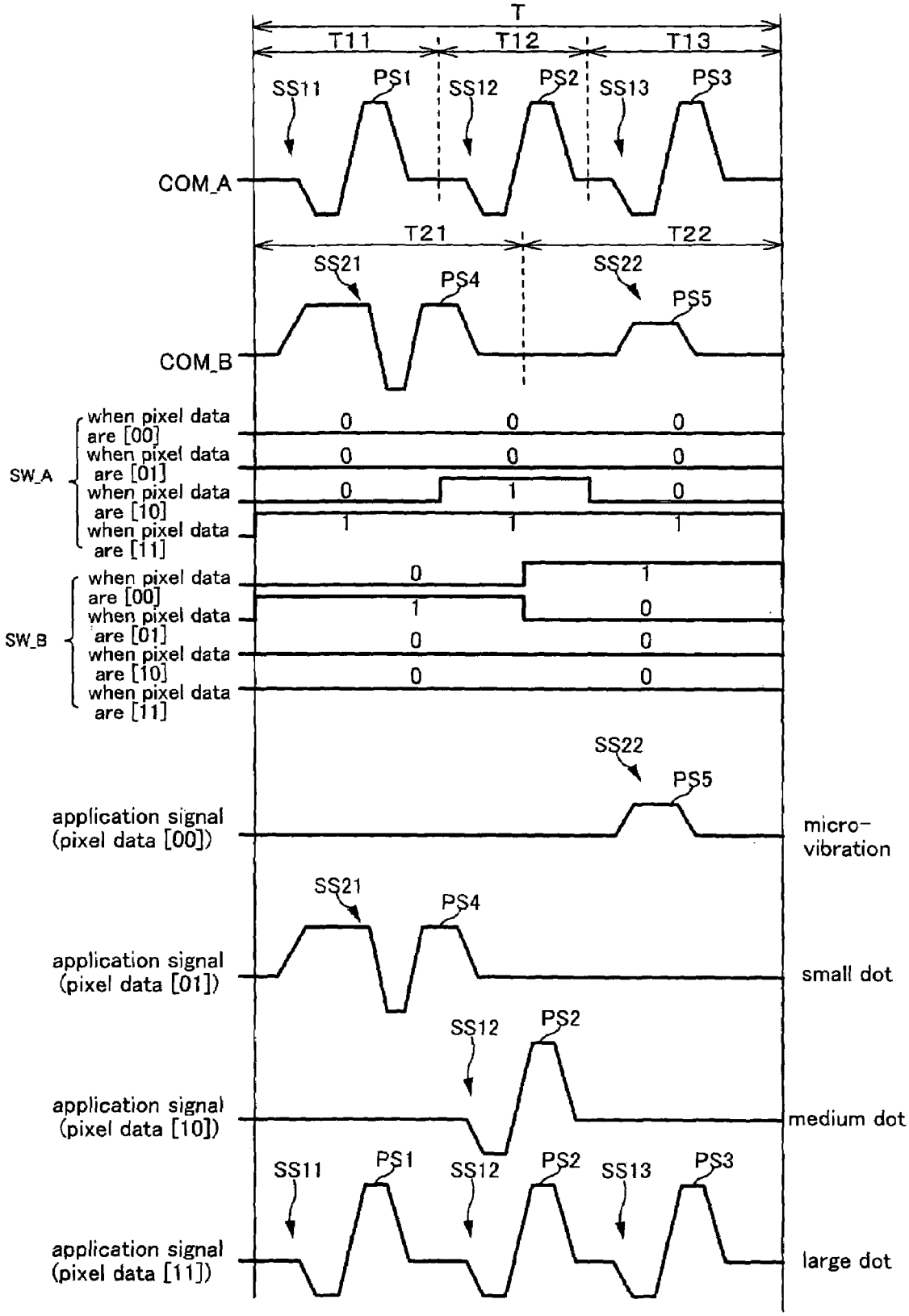
FIG. 13 is an explanatory diagram of the relationship between the drive signals, the switch control signals, and application signals that are applied to piezo elements.

FIG. 13 is an explanatory diagram illustrating the relationship between the first drive signal COM_A, the second drive signal COM_B, the first switch control signal SW_A, the second switch control signal SW_B, and the application signal that is applied to the piezo element 417.

The case of forming a large dot (pixel data SI having the data [11]) is described first. If the pixel data [11] have been latched, the first selection signal q3 is output as the first switch control signal SW_A and the second selection signal q7 is output as the second switch control signal SW_B. Thus, the first switch 86A is ON in period T11, period T12, and period T13, and the second switch 86B is OFF over the period T. As a result, the drive pulse PS1 of the first waveform section SS11 of the first drive signal COM_A, the drive pulse PS2 of the second waveform section SS12 of the first drive signal COM_A, and the drive pulse PS3 of the third waveform section SS13 of the first drive signal COM_A are applied in that order to the piezo element 417, causing the ejection of an ink droplet of an amount of ink that corresponds to a large dot (large ink droplet) from the nozzle Nz.

The case of forming a medium dot (pixel data SI having the data [10]) is described next. If the pixel data [10] have been latched, the first selection signal q2 is output as the first switch control signal SW_A and the second selection signal q6 is output as the second switch control signal SW_B. Thus, the first switch 85A is in the ON state in period T12 and is in the OFF state in the other periods, and the second switch 86B is OFF over the period T. As a result, the drive pulse PS2 of the second waveform section SS12 of the first drive signal COM_A is applied to the piezo element 417, causing the ejection of an ink droplet of an ink amount that corresponds to a medium dot (medium ink droplet) from the nozzle Nz.

The case of forming a small dot (pixel data SI having the data [01]) is described next. If the pixel data [01] have been latched, the first selection signal q1 is output as the first switch control signal SW_A and the second selection signal q5 is output as the second switch control signal SW_2. Thus, the first switch 85A is in the OFF state over the period T, and the second switch 85B is ON in period T21 and is off in period T22. As a result, the drive pulse PS4 of the first waveform section SS21 of the second drive signal COM_A is applied to the piezo element 417, causing the ejection of an ink droplet of an amount that corresponds to a small dot (medium ink droplet) from the nozzle Nz.

The case of no dot formation (pixel data SI having the data [00]) is described next. If the pixel data [00] have been latched, the first selection signal q0 is output as the first switch control signal SW_A and the second selection signal q4 is output as the second switch control signal SW_2. Thus, the first switch 85A is OFF over the period T, and the second switch 85B is OFF in period T21 and is OFF in period T22. As a result, the drive pulse PS5 of the second waveform section SS22 of the second drive signal COM_A is applied to the piezo element 417. In this case, although no ink droplet will be ejected from the nozzle Nz, the driving of the piezo element 417 will cause slight vibration of the ink and agitates the ink within the nozzle.

In this embodiment, if no dot is to be formed, then the combination of the selection signal q0 and the selection signal q4 are selected as the switch control signals from among the selection signals q0 to q7 that are output from the control logic 84. Similarly, if a small dot is to be formed, then the combination of the selection signal q1 and the selection signal q5 are selected as the switch control signals, if a medium dot is to be formed, then the combination of the selection signal q2 and the selection signal q6 are selected, and if a large dot is to be formed, then the combination of the selection signal q3 and the selection signal q7 are selected.

On the other hand, in the present embodiment, one of the two selection signals that constitute a pair is maintained to be zero (at L level) during the period T. For example, in the pair of selection signals selected when forming a large dot (i.e., the selection signal q3 and the selection signal q7), the selection signal q7 is maintained to be zero (at L level) during the period T. This is because the selection data [0] is set in the registers RG that belong to group Q7 in the control logic 84 (see FIG. 9). That is, in the present embodiment, since only the selection data [0] is set in the registers RG belonging to group Q0, group Q1, group Q6, and group Q7, the selection signal q0, the selection signal q1, the selection signal q6, and the selection signal q7 are maintained to be zero (at L level) during the period T, and thus, one of the two selection signals that constitute a pair is maintained to be zero (at L level) during the period T.

As a result, in this embodiment, when forming dots, one of the first switch 86A and the second switch 86B is off over the period T, and thus only one of the first drive signal COM_A and the second drive signal COM_B is selected. Thus, in this embodiment, when forming dots, there are no instances in which a waveform section included in the first drive signal COM_A and a waveform section included in the second drive signal COM_B are applied to the same piezo element 417 in the period T. Further, the first switch 86A and the second switch 86B will not be in the ON state at the same time. (If both switches were to be in the ON state simultaneously, then an unexpected current I would flow between the signal line of the first drive signal COM_A and the signal line of the second drive signal COM_B (see FIG. 14), and this has the possibility of damaging the apparatus.)

When only a single drive signal is selected during the period T, it becomes necessary to provide a number of drive signals corresponding to the number of gradations in order to express a plurality of gradations. For example, in order to express three gradations (large dot, medium dot, and small dot), it is necessary to provide three types of drive signals. Increasing the types of drive signal in this way, however, makes the structure of the apparatus complicated.

In view of the above, in the present embodiment, a predetermined waveform section is further selected from among the plurality of waveform sections included in the selected drive signal COM. For example, in a case where the first drive signal COM_A is selected, all of the waveform sections included in the first drive signal COM_A are selected when forming a large dot, and the second waveform section SS13 included in the first drive signal COM_A is selected when forming a medium dot. On the other hand, in a case where the second drive signal COM_B is selected, the first waveform section SS21 included in the second drive signal COM_B is selected when forming a small dot, and the second waveform section SS22 included in the second drive signal COM_B is selected when forming no dot.

In this way, in the present embodiment, in addition to selecting one of the two drive signals, a predetermined waveform section is further selected from among the plurality of waveform sections included in the selected drive signal COM, and therefore, it is possible to express a larger number of gradations than the number of drive signals.

Second Embodiment

<Regarding the Effect Due to Noise>

In the embodiment discussed above, the printer-side controller 60 outputs a setting signal so that only the selection data [0] is set in the registers RG belonging to group Q0, group Q1, group Q6, and group Q7 of the control logic 84 (see FIG. 9). However, there still is a possibility that an incorrect selection data value will be set to a register RG of the control logic 84, even if the printer-side controller 60 outputs a setting signal in this manner.

This problem is thought to occur primarily due to noise. The setting signal that is output from the printer-side controller 60 is input to the head controller HC, which is provided in the carriage CR, via a flexible cable that connects the body of the printer and the carriage CR. This flexible cable includes not only the signal line for the head control signals such as the clock signal and the setting signal, but also the signal line for the first drive signal COM_A and the signal line for the second drive signal COM_B. Because a large current flows through the signal lines for the drive signals in order to drive the piezo elements 417, there is a possibility that electromagnetic noise will occur in the surrounding area. Thus, there is the possibility that the clock signal and the setting signal that are output from the printer-side controller 60 will be affected by noise in the flexible cable and cause incorrect selection data to be set to a register RG of the control logic 84.

Thus, with the structure of the control logic 84 of the above-described embodiment, there is a possibility that the selection data [1] is set in the registers RG belonging to group Q0, group Q1, group Q6, and group Q7 of the control logic 84. For example, due to the influence of noise, there is a possibility that the selection data [1] is set in the register RG (Q7, G21) belonging to group Q7 of the control logic 84, even though the selection data [0] should have been set therein. As a result, an abnormal selection signal q7 will be output from the control logic 84.

Figure 15A:
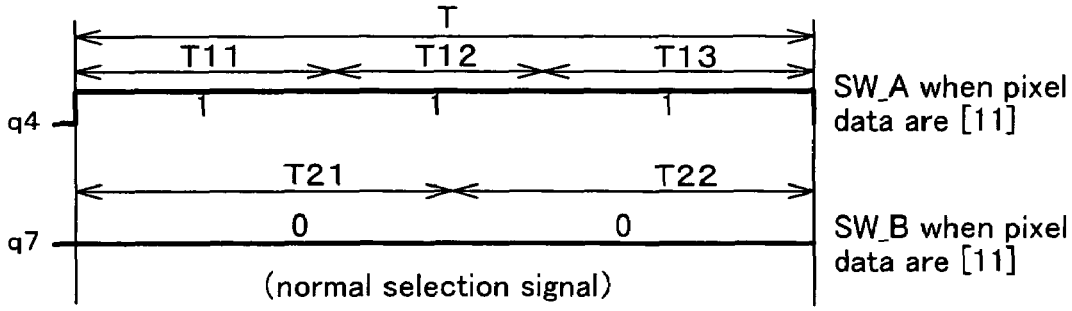
FIG. 15A is an explanatory diagram of a normal selection signal q4 and selection signal q7.
Figure 15B:
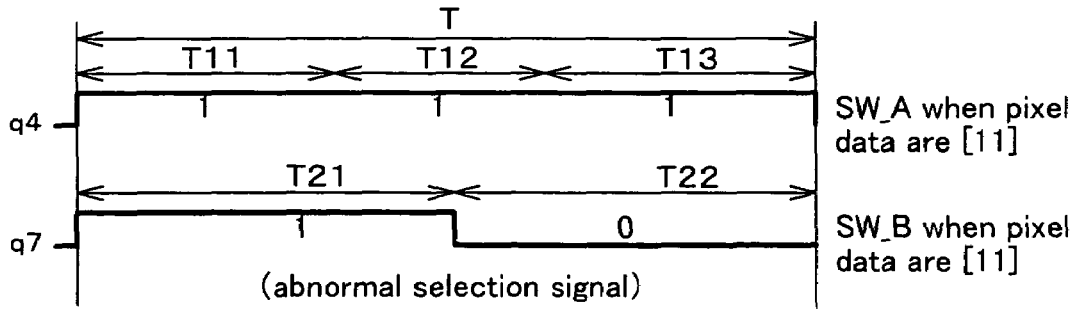
FIG. 15B is an explanatory diagram of an abnormal selection signal q4 and selection signal q7.

FIG. 15A is an explanatory diagram illustrating a normal selection signal q4 and selection signal q7. FIG. 15B is an explanatory diagram illustrating an abnormal selection signal q4 and selection signal q7. When normal, the selection signal q4 and the selection signal q7 will not both take the value 1 (H level) at the same time. However, when abnormal selection data are set to the register RG (Q7, G21) belonging to group Q7 of the control logic 84, then the selection signal q4 and the selection signal q7 simultaneously take the value 1 (H level) in the period T21.

In this way, when the selection signal q4 and the selection signal q7, which constitute a pair, both take the value 1 simultaneously, then when the pixel data that have been latched are the data [11], the first switch 86A and the second switch 86B become ON at the same time. When these two switches become ON at the same time, an unexpected current I flows between the signal line for the first drive signal COM_A and the signal line for the second drive signal COM_B (see FIG. 14), and this may damage the apparatus.

<Regarding the Control Logic 84 of the Present Embodiment>

Figure 16:
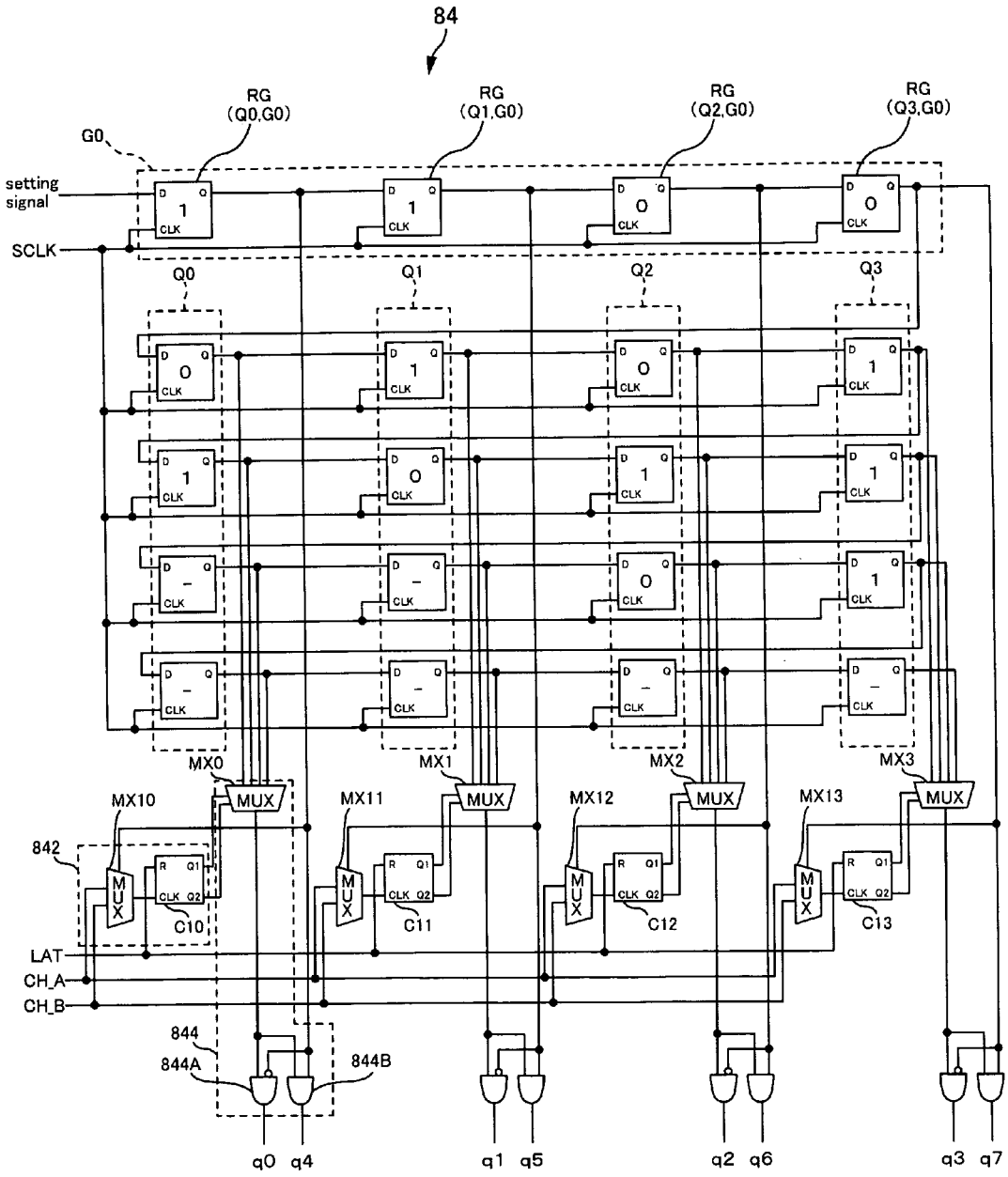
FIG. 16 is an explanatory diagram of a control logic of a second embodiment.
Figure 17A:
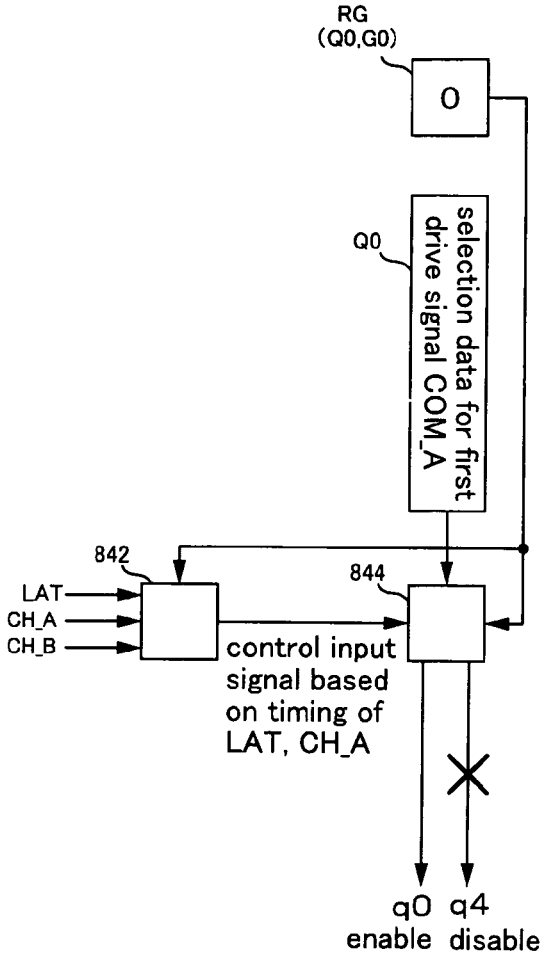
FIG. 17A is an explanatory diagram of an operation of a control logic 84 when the drive waveform selection data is [0]
Figure 17B:
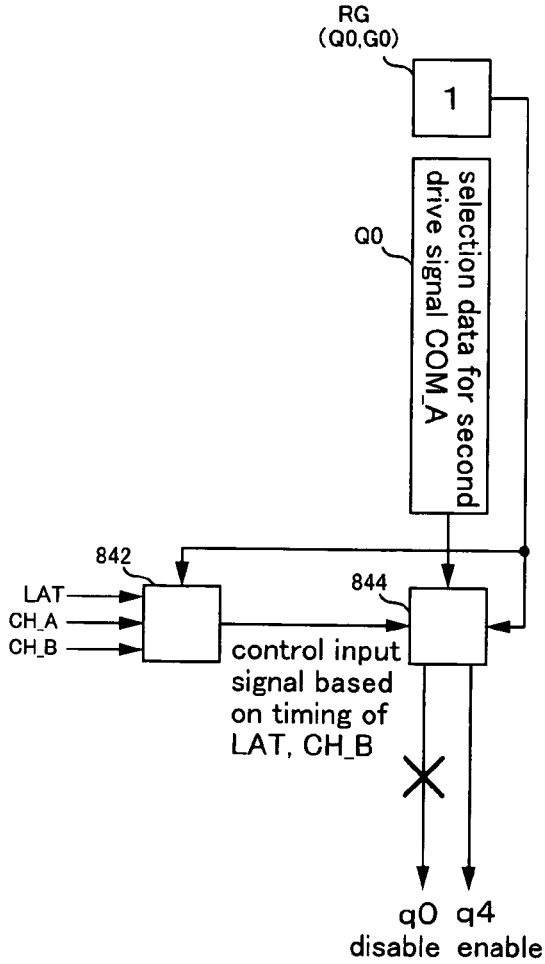
FIG. 17B is an explanatory diagram of an operation of the control logic 84 when the drive waveform selection data is [1].

FIG. 16 is an explanatory diagram of the control logic 84 of the second embodiment. FIG. 17A is an explanatory diagram illustrating the operation of the control logic 84 when the drive waveform selection data is [0]. FIG. 17B is an explanatory diagram illustrating the operation of the control logic 84 when the drive waveform selection data is [1].

The configuration of the control logic 84 of the second embodiment differs from the configuration of the control logic 84 of the first embodiment in the following aspects. First, in the present embodiment, four additional registers RG for storing data for selecting a drive signal (drive signal selection data) are provided. These four registers RG are shown as the registers RG belonging to group G0 in FIG. 16. On the other hand, in the present embodiment, the registers RG of group Q4 and group Q7 have been omitted. Further, in the present embodiment, the configuration of, for example, a timing control section 842 for performing an input of control to the multiplexer MX0 to the multiplexer MX3, and an output section 844 for creating two selection signals from the selection data stored on the four registers RG, is different from that of the first embodiment. The configuration of the present embodiment is described in further detail below.

The registers RG belonging to group 0 , like the registers RG belonging to groups Q0 to Q3, are constituted by D-FF (delay flip flop) circuits that can store one bit of data each. Data are set to the registers RG belonging to group G0 in accordance with a setting signal from the printer-side controller 60, which is also how data are set to the registers RG belonging to groups Q0 to Q3.

The timing controller 842 has multiplexers MX10 to MX 13 and counters C10 to C13. The timing controller 842 inputs control to each of the multiplexers MX10 to MX13. Here, a timing controller 842 that is made of the multiplexer MX10 and the counter 10 is described. The first change signal CH_A and the second change signal CH_B are input to the multiplexer MX10. The multiplexer MX10 switches the signal that it outputs based on the control input of the drive signal selection data stored on the register RG (Q0, G0) of group G0. If the drive signal selection data value is [0], then it outputs the first change signal CH_A, and if the drive signal selection data value is [1], then it outputs the second change signal CH_B. The signal that is output from the multiplexer MX10 is input to the clock terminal of the counter C10. The counter C10 is reset by the latch pulse of the latch signal LAT, and each time the change pulse of the change signal is output from the multiplexer MX10, it raises the two-bit output. The timing controller 842 outputs this two-bit signal to the multiplexer MX0 of the output section 844.

The output section 844 has multiplexers MX0 through MX3 and AND gates. The output section 844 outputs the selection signals q0 to q7 to the decoder 83. An output section 844 that is made of the multiplexer MX0, an AND gate 844A, and an AND gate 844B is described here.

Selection data are input from the registers RG of group Q0 to the multiplexer MX0. Then, the multiplexer MX0 switches the signal that is output based on the two-bit information from the counter C10 of the timing controller 842. Thus, the multiplexer MX0 selects selection data at the timing of the latch pulse and the change pulses.

The AND gate 844A and the AND gate 844B receive the signal that is output from the multiplexer MX0. The AND gate 844A receives the inverted data of the drive signal selection data stored on the register RG (Q0, G0) in group G0. On the other hand, the AND gate 844B receives the drive signal selection data stored on the register RG (Q0, G0) in group G0. Thus, if the drive signal selection data is the value [0], then the signal output from the multiplexer MX0 is the selection signal q0, and the selection q4 becomes [0] (L level). On the other hand, if the drive signal selection data is the value [1], then the selection signal q0 becomes [0] (L level), and the signal that is output from the multiplexer MX0 becomes the selection signal q4.

That is, if the drive signal selection data is [0], then the AND gate 844A of the output section 844 outputs the selection signal q0, which is switched at the timing of the latch signal LAT and the first change signal CH_A, and the AND gate 844B outputs the selection signal q4, which is maintained at the value [0] (L level). On the other hand, if the drive signal selection data is [1], then the AND gate 844A of the output section 844 outputs the selection signal q0, which is maintained at the value [0] (L level), and the AND gate 844B outputs the selection signal q4, which is switched at the timing of the latch signal LAT and the second change signal CH_B.

Thus, the selection data that are set to the registers RG of group Q0 become data for setting the selection signal q0 if the drive signal selection data is [0], and become data for setting the selection signal q4 if the drive signal selection data is [1]. Here, the selection signal q0 becomes the first switch control signal SW_A (a signal for selecting a waveform section of first drive signal COM_A) when the pixel data are [00], and the selection signal q4 becomes the second switch control signal SW_B (a signal for selecting a waveform section of second drive signal COM_B) when the pixel data are [00]. Consequently, the selection data that are set to the registers RG of group Q0 become data for selecting a waveform section of the first drive signal COM_A if the drive signal selection data is [0], and become data for selecting a waveform section of the second drive signal COM_B if the drive signal selection data is [1].

In this way, with the present embodiment, one of the two selection signals constituting a pair is enabled, and the other selection signal is disabled, depending on the drive signal selection data stored on the registers RG belonging to group G0. Thus, even if noise causes an error in the data stored on a register RG belonging to group G0 or the data stored on a register RG belonging to one of groups Q0 to Q3, the two selection signals constituting a pair will not both take the value [1] (H level) at the same time. Thus, with the present embodiment, the first switch control signal and the second switch control signal are prevented from entering the ON state at the same time. Further, with the present embodiment, because one of the two selection signals constituting a pair is disabled, it is possible to reduce the storage capacity by that amount of selection data, and thus the number of registers RG can be reduced.

Other Embodiments

The foregoing embodiment primarily describes a printing system 100 that includes a printer 1, but it also includes the disclosure of methods of applying drive signals COM and liquid ejection systems, etc. The foregoing embodiment is for the purpose of facilitating understanding of the present invention, and is not to be interpreted as limiting the present invention. The invention can of course be altered and improved without departing from the gist thereof, and includes equivalents. In particular, the embodiments mentioned below also are within the scope of the invention.

<Regarding the Drive Signal COM>

The foregoing embodiment offered an example of a printer 1 that simultaneously generates two types of drive signals COM, namely the first drive signal COM_A and the second drive signal COM_, but there is no limitation to this configuration. That is, it is also possible to adopt a printer 1 that is capable of simultaneously generating three or more types of drive signals COM. Further, the first drive signal COM_A and the second drive signal COM_only constitute one example, and other waveforms are also possible.

<Regarding the Ink>

The foregoing embodiment is an embodiment of a printer 1, and thus the nozzles Nz eject dye ink or pigment ink in liquid form. However, as long as the ink that is ejected from the nozzles Nz is a liquid, then there is no limitation to such inks.

<Regarding Other Application Examples>

A printer 1 was described in the above embodiment, but this is not a limitation. For example, it is also possible to adopt the same technology as that of the embodiment to various types of liquid ejection apparatuses that employ inkjet technology, such as a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. The methods therefor and manufacturing methods thereof are also within the scope of application.

In Summary (1) The printer described above (one example of "liquid ejection apparatus") has a head 41, a drive signal generation circuit 70, and a head controller HC (see FIG. 2). The head 41 includes a plurality of nozzles Nz for ejecting ink droplets (one example of "liquid droplet"), and a plurality of piezo elements (one example of "element") each provided in correspondence with a respective nozzle (see FIG. 4 and FIG. 8). The drive signal generation circuit 70 generates a first drive signal COM_A and a second drive signal COM_B, and both drive signals COM includes a plurality of waveform sections (see FIG. 7). The head controller controls the ON/OFF states of a first switch 86A and a second switch 86B to apply a drive signal COM to the piezo elements 417 (see FIG. 8).

Figure 14:
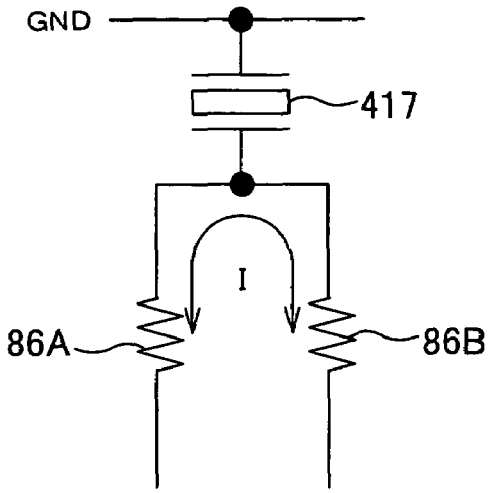
FIG. 14 is a diagram for schematically describing a state in which a first switch and a second switch have been put in the ON state at the same time.

If the first switch 86A and the second switch 86B both were to be in the ON state at the same time, then there is a possibility that an unanticipated current I would flow between the signal line for the first drive signal COM_A and the signal line for the second drive signal COM_B, and this may damage the apparatus (see FIG. 14). In view of the above, it is possible to conceive a configuration in which one of the switches is kept OFF constantly during the repeat period T (the period from a latch pulse to the next latch pulse in the latch signal) so that only one drive signal is applied. Conventionally, however, in a configuration in which only one of the drive signals is applied, it has been necessary to provide a number of types of drive signals equal to the number of types of signals to be applied to the piezo element 417.

In the first embodiment and the second embodiment described above, the head controller HC further selects a predetermined waveform section from among the plurality of waveform sections included in the drive signal COM that has been selected. For example, in a case where the first drive signal COM_A is selected, all of the waveform sections included in the first drive signal COM_A are selected when forming a large dot, and the second waveform section SS13 included in the first drive signal COM_A is selected when forming a medium dot. In this way, it is possible to apply, to the piezo element, more types of signals than the types of drive signals.

(2) In the first embodiment and the second embodiment described above, the drive signal generation circuit 70 generates the first drive signal COM_A by repetitively generating the waveform sections SS11 to SS13 with the period T, and generates the second drive signal COM_B by repetitively generating the waveform section SS21 and waveform section SS22 with the same period T. If the drive signal were to be switched in the middle of the repeat period T, both the first switch 86A and the second switch 86B may turn ON at the same time during the switching. In contrast, with the first embodiment and the second embodiment described above, the head controller HC selects only one drive signal in a repeat period T, rather than switching the drive signals in the middle of the period and applying the signal to the piezo element 417. In this way, the first switch 86A and the second switch 86B are prevented from entering the ON state at the same time.

(3) In the first embodiment and the second embodiment described above, the head controller HC applies four types of application signals (see FIG. 13) to the piezo element 417 in accordance with the pixel data. In this way, it is possible to cause ink droplets of different sizes from the nozzle Nz and thereby form dots of different sizes on the paper S.

It should be noted that, as described in the embodiments above, the signals applied to the piezo element 417 do not have to have the aim of causing ejection of ink droplets, but may have the aim of stirring the ink inside the nozzle.

(4) In the first embodiment and the second embodiment described above, the head controller HC includes the first switch 86A and the second switch 86B. Further, the head controller HC controls the switches such that, when one of the switches is in the ON state, the other switch is in the OFF state.

Specifically, in the first embodiment, the head controller HC controls the ON/OFF of both switches in the following way. The head controller HC sets the selection data [0] to the register RG that belongs to either group Q0 or group Q4 of the control logic 84 of the head controller HC, sets the selection data [0] to the register RG that belongs to either group Q1 or group Q5, sets the selection data [0] to the register RG that belongs to either group Q2 or group Q6, and sets the selection data [0] to the register RG that belongs to either group Q3 or group Q7. In this way, one of the two selection signals that constitute a pair (for example, the selection signal q0 and the selection signal q4) is maintained to be [0] (at L level) constantly. As a result, when two selection signals that constitute a pair are selected as the switch control signals by the decoder 83, one of the switches will be maintained in the OFF state. By doing this, the two switches are prevented from both entering the ON state at the same time.

(5) In the first embodiment, however, if erroneous data is set to the register RG, then there is a possibility that both switches will be turned ON at the same time.

In view of this, in the second embodiment, the control logic 84 of the head controller HC is provided with registers RG (an example of a memory) that belong to group G0, in addition to the registers RG (an example of a memory) that belong to groups Q0 to Q3 for selecting the waveform section. The registers RG belonging to group G0 store drive signal selection data for selecting one of the first drive signal COM_A and the second drive signal COM_B.

With such a configuration of the second embodiment, even when erroneous data is set to the registers RG that belong to groups Q0 to Q3 and/or the registers RG that belong to group G0 it is possible to prevent both switches from entering the ON state at the same time. Further, since there is no need to provide memories for selecting the waveform section of the non-selected drive signal, it is possible to reduce the number of registers RG compared to the first embodiment.

(6) If both the selection signal for the drive signal COM_A and the selection signal for the drive signal COM_B are enabled, then there is a possibility that both switches enter the ON state at the same time.

In contrast, with the second embodiment described above, when the drive signal selection data is [0], then the selection signal for the first drive signal COM_A (for example the selection signal q0) is enabled and the selection signal for the second drive signal COM_B (for example the selection signal q4) is disabled, whereas when the drive signal selection data is [1], the selection signal for the first drive signal COM_A is disabled and the selection signal for the second drive signal COM_B is enabled. In this way, the head controller HC can put one of the switches in the OFF state based on the drive signal selection data.

(7) In the printer described above, the carriage CR can be moved relative to the body of the apparatus. On the other hand, it is necessary to transmit the head control signals (latch signal LAT, first change signal CH_A, second change signal CH_B, clock signal CLK, pixel data SI, setting signal) and the drive signals (first drive signal COM A, second drive signal COM_B) to the head controller HC, which is provided in/on the carriage CR, from the printer-side controller 60 and the drive signal generation circuit 70 of the body of the apparatus (see FIG. 2, FIG. 6) In the printer described above, these signals are transmitted over a flexible cable (one example of "cable"). Here, a large current for driving the piezo elements flows through the signal line for the first drive signal COM_A and the signal line for the second drive signal COM_B, and thus there is a possibility that electromagnetic noise will occur in the surrounding area. When the setting signal is affected by noise, there is a possibility that incorrect data will be set to the registers RG of the control logic 84.

However, the configuration of the above second embodiment allows the two switches to be prevented from both entering the ON state at the same time, even if the setting signal is affected by noise and as a result sets incorrect data to the registers RG.

(8) There is also a possibility that incorrect data will be set to the registers RG of the control logic 84 if the clock signal CLK for transfer, which is used when setting the data to the registers RG, is affected by noise. However, with the configuration of the above second embodiment, it is possible to prevent both switches from entering the ON state at the same time.

(9) Because piezo elements (one example of "piezoelectric element") are used, it is necessary to set a high voltage for the drive signals COM, and thus, in the above embodiment in particular, electromagnetic noise is prone to occur around the signal lines over which the drive signals are transferred. With the configuration of the above second embodiment, however, it is possible to prevent both switches from entering the ON state at the same time.

What is claimed is:

1. A liquid ejection apparatus comprising:

a head having a plurality of nozzles each for ejecting a liquid droplet, and a plurality of elements each provided in correspondence with a respective one of the nozzles;

a drive signal generation section that generates a first drive signal including a plurality of waveform sections, and a second drive signal that is different from the first drive signal and that includes a plurality of waveform sections; and a controlling section that drives the element to cause the liquid droplet to be ejected from the nozzle, by selecting one of the first drive signal and the second drive signal, further selecting a predetermined waveform section from among the plurality of waveform sections included in the drive signal that has been selected, and applying, to the element, the predetermined waveform section that has been selected, wherein the controlling section comprises:

a first switch for controlling application of the waveform section included in the first drive signal to the element, a second switch for controlling application of the waveform section included in the second drive signal to the element, a memory that stores drive signal selection data for selecting one drive signal of the first drive signal and the second drive signal, waveform section selection data for selecting the waveform section from the drive signal that has been selected, and a first AND gate and a second AND gate, the first AND gate and the second AND gate each having input therein a signal according to the waveform section selection data, one of the first AND gate and the second AND gate having input therein a signal according to the drive signal selection data, and the other of the first AND gate and the second AND gate having input therein an inverted signal of the signal according to the drive signal selection data, wherein the controlling section, by controlling the first switch with the use of an output of the first AND gate and controlling the second switch with the use of an output of the second AND gate, puts one switch, of the first switch and the second switch corresponding to the drive signal, that is not selected in an OFF state based on the drive signal selection data, when the first switch is in the OFF state based on the drive signal selection data, the second switch is controlled based on the waveform section selection data, and when the second switch is in the OFF state based on the drive signal selection data, the first switch is controlled based on the waveform section selection data.

2. A liquid ejection apparatus according to claim 1, wherein the drive signal generation section generates the first drive signal and the second drive signal by repetitively generating the plurality of waveform sections with a predetermined period; and wherein the controlling section selects one of the first drive signal and the second drive signal in the predetermined period.

3. A liquid ejection apparatus according to claim 1, wherein the controlling section causes liquid droplets of different sizes to be ejected from the nozzle.

4. A liquid ejection apparatus according to claim 1, wherein the liquid ejection apparatus farther comprises a carriage that can be moved with respect to a body of the apparatus, and a cable for transmitting signals from the body of the apparatus to the drive signal generation section and the controlling section that provided the signals to the carriage; and wherein the cable transmits the first drive signal, the second drive signal, and a setting signal for setting the waveform section selection data to the memory.

5. A liquid ejection apparatus according to claim 4, wherein the elements are piezoelectric elements.

6. A liquid ejection apparatus according to claim 1, wherein the liquid ejection apparatus further comprises a carriage that can be moved with respect to a body of the apparatus, and a cable for transmitting signals from the body of the apparatus to the drive signal generation section and the controlling section that provided the signals to the carriage; and wherein the cable transmits the first drive signal, the second drive signal, and a clock signal for causing the memory to operate.

7. A liquid ejection method comprising:

storing in a memory drive signal selection data for selecting one drive signal of the first drive signal and the second drive signal, and waveform section selection data for selecting the waveform section from the drive signal that has been selected;

generating a first drive signal including a plurality of waveform sections, and a second drive signal that is different from the first drive signal and that includes a plurality of waveform sections;

putting one switch of a first switch and a second switch corresponding to the drive signal that is not selected in an OFF state based on the drive signal selection data, the first switch controlling application to the element of the waveform section included in the first drive signal, the second switch controlling application to the element of the waveform section included in the second drive signal;

further selecting a predetermined waveform section from among the plurality of waveform sections included in the drive signal that has been selected;

inputting into each of a first AND gate and a second AND gate a signal according to the waveform section selection data, one of the first AND gate and the second AND gate having input therein a signal according to the drive signal selection data, and the other of the first AND gate and the second AND gate having input therein an inverted signal of the signal according to the drive signal selection data, by controlling the first switch with the use of an output of the first AND gate and by controlling the second switch with the use of an output of the second AND gate, putting one switch of the first switch and the second switch corresponding to the drive signal that is not selected in the OFF state based on the drive signal selection data, and selecting one drive signal of the first drive signal and the second drive signal, when the first switch is in the OFF state based on the drive signal selection data, the second switch is controlled based on the waveform section selection data, and when the second switch is in the OFF state based on the drive signal selection data, the first switch is controlled based on the waveform section selection data;

applying, to an element, the predetermined waveform section that has been selected; and driving the element to eject a liquid droplet from a nozzle.

8. A printing system comprising:

a computer unit; and a printing apparatus, the printing apparatus including a head having a plurality of nozzles each for ejecting an ink droplet, and a plurality of elements each provided in correspondence with a respective one of the nozzles, a drive signal generation section that generates a first drive signal including a plurality of waveform sections, and a second drive signal that is different from the first drive signal and that includes a plurality of waveform sections, and a controlling section that drives the element to cause the ink droplet to be ejected from the nozzle, by selecting one of the first drive signal and the second drive signal, further selecting a predetermined waveform section from among the plurality of waveform sections included in the drive signal that has been selected, and applying, to the element, the predetermined waveform section that has been selected, wherein the controlling section comprises:

a first switch for controlling application of the waveform section included in the first drive signal to the element, a second switch for controlling application of the waveform section included in the second drive signal to the element, and a memory that stores drive signal selection data for selecting one drive signal of the first drive signal and the second drive signal, and waveform section selection data for selecting the waveform section from the drive signal that has been selected, a first AND gate and a second AND gate, the first AND gate and the second AND gate each having input therein a signal according to the waveform section selection data, one of the first AND gate and the second AND gate having input therein a signal according to the drive signal selection data, and the other of the first AND gate and the second AND gate having input therein an inverted signal of the according to the drive signal selection data, wherein the controlling section by controlling the first switch with the use of an output of the first AND gate and controlling the second switch with the use of an output of the second AND gate, puts one switch, of the first switch and the second switch corresponding to the drive signal, that is not selected in an OFF state based on the drive signal selection data, when the first switch is in the OFF state based on the drive signal selection data, the second switch is controlled based on the waveform section selection data, and when the second switch is in the OFF state based on the drive signal selection data, the first switch is controlled based on the waveform section selection data.

* * * * *